US006715512B2

(12) United States Patent
Richardson

(10) Patent No.: US 6,715,512 B2
(45) Date of Patent: Apr. 6, 2004

(54) FENCE MESH FORMING MACHINE

(75) Inventor: Kenneth Sidney Richardson, North Canterbury (NZ)

(73) Assignee: South Fence Machinery Limited., Christchurch (NZ)

( * ) Notice: Subject to any disclaimer, the term of this patent is extended or adjusted under 35 U.S.C. 154(b) by 0 days.

(21) Appl. No.: 10/157,092

(22) Filed: May 29, 2002

(65) Prior Publication Data

US 2003/0221742 A1 Dec. 4, 2003

(51) Int. Cl.[7] ..... B21F 27/08
(52) U.S. Cl. ..... 140/11; 140/101
(58) Field of Search ..... 140/3 R, 5, 6, 140/9, 10, 11, 101

(56) References Cited

U.S. PATENT DOCUMENTS 1,027,454 A * 5/1912 Willits ..... 140/11
4,169,307 A * 10/1979 Weinzimer et al. ..... 140/11

* cited by examiner

*Primary Examiner*—Lowell A. Larson
(74) *Attorney, Agent, or Firm*—Workman Nydegger

(57) ABSTRACT

A knotted fence mesh forming machine includes a plurality of side-by-side knot boxes each for forming a knot at the intersection between a line wire and stay wire, each of the knot boxes including at least one former arranged to move towards the line wire-stay wire intersection at each operation of the knot box, the former being hydraulically driven and/or hydraulically damped. More than one former may be provided in each knot box. A transversely moveable rack bar may be driven by a hydraulic cylinder, the transverse movement resulting in orthogonal movement of a drive bar which moves respective former or supports. A final former in each knot box is preferably hydraulically damped.

51 Claims, 15 Drawing Sheets

FENCE MESH FORMING MACHINE

CROSS-REFERENCE TO RELATED APPLICATIONS

Not applicable.

BACKGROUND OF THE INVENTION

1. The Field of the Invention

This in invention relates to apparatus for forming knotted fence mesh.

2. The Relevant Technology

Forms of fence mesh are known in which the wires forming the fence are knotted together at each or many wire intersections. In general knotted fence mesh is stronger than wire fence in which the fence wires are not knotted together at their intersections and which it is typically used for domestic or light industrial applications. Knotted fence mesh is used for applications where additional strength is required, such as for containing larger or stronger animals such as horses or deer for example.

Knotted fence mesh with a rectangular or square mesh shape for example is typically formed from a number of generally parallel line wires, which will extend generally horizontally when the fence mesh is set in position between fence posts, and lengths of stay wire which extend laterally across the line wires at regular spacings (and generally vertically when the fence mesh is set in position). In machines for forming knotted fence mesh a number of continuous line wires are fed to a bed of the machine comprising a number of similar knot boxes, and stay wire is fed into the machine bed across the line wires. Such machines typically have a step-wise operation and form a series of knots along a length of stay wire at each intersection of the stay wire and the line wires at each operational step or "beat" of the machine. Typically such machines may operate at a rate of around 50 to 60 beats per minute. At each step or beat the line wires are advanced forward in parallel through the side by side knot boxes at the machine bed, stay wire is fed into the bed of the machine across the line wires at the knot boxes, at approximately 90 degrees to the line wires in case of a machine for forming rectangular fence mesh, a length of the stay wire is cut, and simultaneously at each knot box at an intersection between the line wires and the stay wire a knot securing the stay wire to the line wire is formed.

In conventional machines, these knots are formed by mechanically actuated-formers. Such machines need regular fine adjustment to ensure relatively consistent knots are formed. Further, the machines do not compensate for variations in wire diameter, tooling wear and/or build-up of wire galvanizing debris. Hence, machines having mechanically-actuated former may produce knots of varying consistency.

SUMMARY OF INVENTION

The invention provides an improved or at least alternative form of fence mesh forming machine. The machine of the invention is particularly suited for forming knotted fence mesh having a rectangular mesh shape and in which at each line wire-stay wire intersection a length of knot wire is wrapped or knotted around the intersection, but may be adapted for forming a knotted fence with a non-rectangular mesh shape such as a diamond mesh shape for example.

In accordance with a first aspect of the present invention, there is provided a knotted fence mesh forming machine including a machine bed with a plurality of side by side knot boxes each for forming a knot at the intersection between a line wire and a stay wire, each of the knot boxes including:

a first former arranged to move towards the line wire-stay wire intersection from one side in forming a knot at the line wire-stay wire intersection at each operation of the knot box; and a second former arranged to move towards the line wire-stay wire intersection from a side opposite the first former at each operation of the knot box;

the machine including a hydraulic drive system arranged to move a plurality of the first former and/or the second former at each operation of the knot boxes.

The hydraulic drive system is preferably arranged to simultaneously move the first former of all of the knot boxes or the second former of all of the knot boxes at each operation of the knot boxes. More preferably, the hydraulic drive system is arranged to move the first former of all of the knot boxes simultaneously with one another and the second former of all of the knot boxes simultaneously with one another at each operation of the knot boxes.

Advantageously, one or more hydraulic cylinders are operably connected to a drive bar, which is operably connected to the plurality of the first former. In a particularly preferred embodiment, a hydraulic cylinder is operably connected to a transversely moveable rack bar having a plurality of camming surfaces defined therein, and a plurality of cam followers extend from the drive bar, each cam follower engaging with a respective one of the camming surfaces, the camming surfaces being arranged such that transverse movement of the rack bar results in orthogonal movement of the drive bar, thereby moving the first former.

Alternatively, the machine includes a plurality of hydraulic cylinders, with a ram of each hydraulic cylinder being operably connected to a respective first former.

Similarly, one or more hydraulic cylinders may be operably connected to a drive bar, which is operably connected to the plurality of the second former. Again, in a particularly preferred embodiment, a hydraulic cylinder is operably connected to a transversely moveable rack bar having a plurality of camming surfaces defined therein, and a plurality of cam followers extend from the drive bar, each cam follower engaging with a respective one of the camming surfaces, the camming surfaces being arranged such that transverse movement of the rack bar results in orthogonal movement of the drive bar, thereby moving the second former.

Alternatively, the machine includes a plurality of hydraulic cylinders, with a ram of each hydraulic cylinder being operably connected to a respective second former.

Each knot box preferably includes a first support arranged to support the line wire-stay wire intersection from the side opposite the first former during movement of the first former.

One or more hydraulic cylinders may be operably connected to a drive bar, which is operably connected to the plurality of first supports. In a particularly preferred embodiment, a hydraulic cylinder is operably connected to a transversely moveable rack bar having a plurality of camming surfaces defined therein, and a plurality of cam followers extend from the drive bar, each cam follower engaging with a respective one of the camming surfaces, the camming surfaces being arranged such that transverse movement of the rack bar results in orthogonal movement of the drive bar, thereby moving the first supports.

Alternatively, the machine may include a plurality of hydraulic cylinders, with a ram of each hydraulic cylinder being operably connected to a respective first support. In a preferred embodiment, each hydraulic cylinder has two rams, with one ram operably connected to a respective first support and the other ram operably connected to a respective second former.

Each knot box preferably includes a second support arranged to support the line wire-stay wire intersection from the side opposite the second former during movement of the second former.

One or more hydraulic cylinders may be operably connected to a drive bar, which is operably connected to the plurality of second supports. In a particularly preferred embodiment, a hydraulic cylinder is operably connected to a transversely moveable rack bar having a plurality of camming surfaces defined therein, and a plurality of cam followers extend from the drive bar, each cam follower engaging with a respective one of the camming surfaces, the camming surfaces being arranged such that transverse movement of the rack bar results in orthogonal movement of the drive bar, thereby moving the second supports.

Alternatively, the machine may include a plurality of hydraulic cylinders, with a ram of each hydraulic cylinder being operably connected to a respective second support. In a preferred embodiment, each hydraulic cylinder has two rams, one ram being operably connected to a respective second support, the other ram being operably connected to a respective first former.

In accordance with a second aspect of the present invention, there is provided a knotted fence mesh forming machine including a machine bed with a plurality of side by side knot boxes each for forming a knot at the intersection between a line wire and a stay wire, each of the knot boxes including:

a former arranged to move towards the line wire-stay wire intersection from one side and form a knot at the intersection at each operation of the knot box;

the machine including a drive system arranged to move a plurality of the former at each operation of the knot boxes;

wherein at least some of the former are hydraulically driven and/or hydraulically damped.

A hydraulic drive system may be provided to simultaneously move a plurality of the former at each operation of the knot boxes.

The hydraulic drive system preferably includes one or more hydraulic cylinders operably connected to a drive bar, which is operably connected to the plurality of the former. In a particularly preferred embodiment, a hydraulic cylinder is operably connected to a transversely moveable rack bar having a plurality of camming surfaces defined therein, and a plurality of cam followers extend from the drive bar, each cam follower engaging with a respective one of the camming surfaces, the camming surfaces being arranged such that transverse movement of the rack bar results in orthogonal movement of the drive bar, thereby moving the former.

Alternatively, the drive system includes a plurality of hydraulic cylinders, with a ram of each hydraulic cylinder being operably connected to a respective former.

Advantageously, each former is hydraulically damped. In a preferred embodiment, a damping hydraulic cylinder is operably connected to each former. Each damping hydraulic cylinder may be located in a respective former holder.

In a preferred embodiment, each damping hydraulic cylinder is pressurized to a constant pressure. The drive system may be arranged to over-stroke when moving a plurality of the former at each operation of the knot boxes, and the damping hydraulic cylinders may be arranged to compress slightly, thereby providing even pressure to each former at each operation of the knot boxes.

Each former is preferably a final former.

Preferably each knot box includes a first former arranged to move towards the line wire-stay wire intersection from a side opposite the final former at each operation of the knot box, prior to or concurrently with the movement of the final former.

A hydraulic drive system may be provided to simultaneously move a plurality of the first former at each operation of the knot boxes.

The hydraulic drive system preferably includes one or more hydraulic cylinders operably connected to a drive bar, which is operably connected to the plurality of the first former. In a particularly preferred embodiment, a hydraulic cylinder is operably connected to a transversely moveable rack bar having a plurality of camming surfaces defined therein, and a plurality of cam followers extend from the drive bar, each cam follower engaging with a respective one of the camming surfaces, the camming surfaces being arranged such that transverse movement of the rack bar results in orthogonal movement of the drive bar, thereby moving the first former.

Alternatively, the drive system includes a plurality of hydraulic cylinders, with a ram of each hydraulic cylinder being operably connected to a respective first former.

BRIEF DESCRIPTION OF THE DRAWINGS

Preferred embodiments of the present invention will be described with reference to the accompanying drawings in which.

DETAILED DESCRIPTION OF THE PREFERRED EMBODIMENTS

Figure 1A:
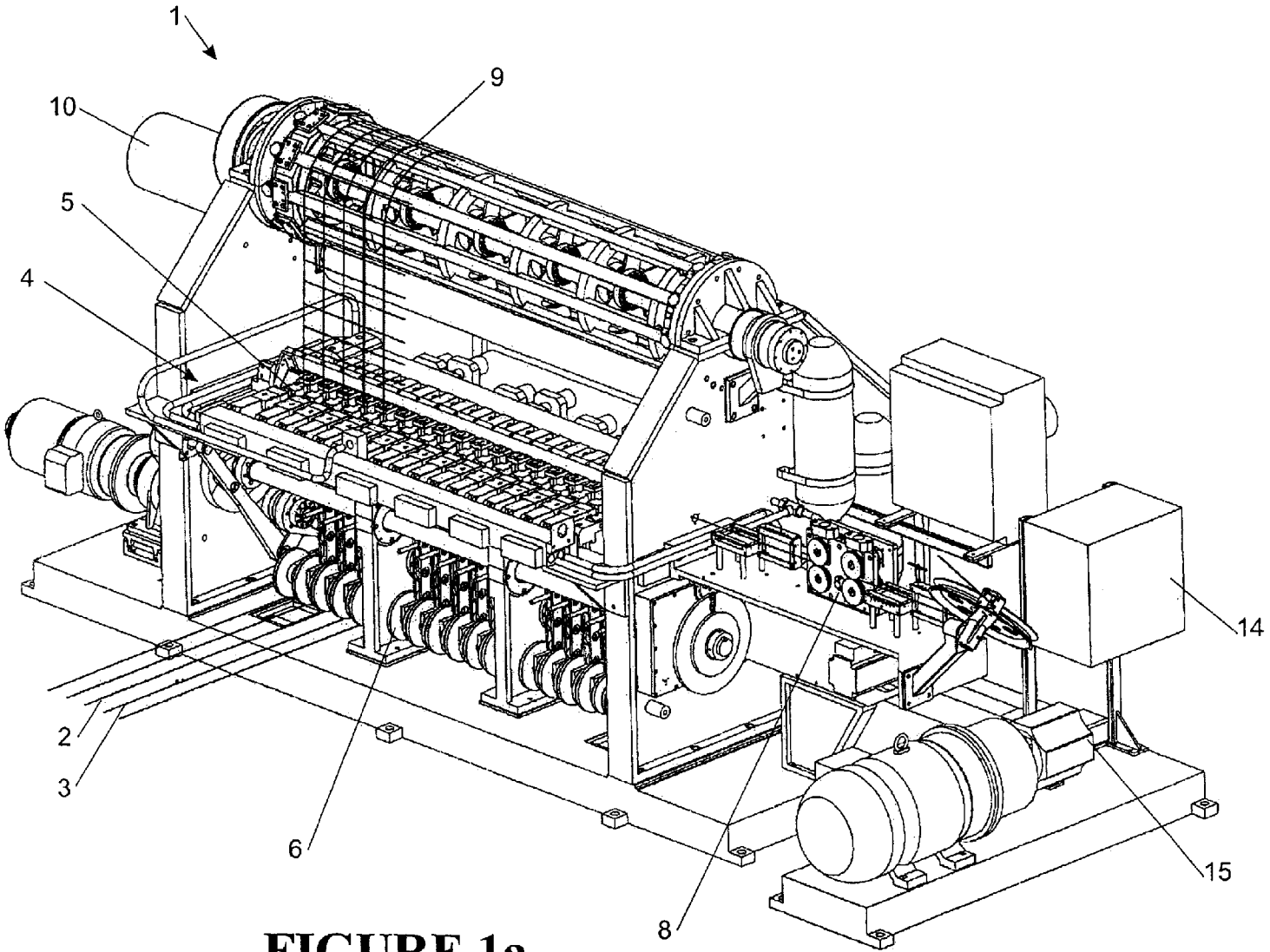
FIG. 1 shows perspective views of a knotted fence mesh forming machine, which includes a plurality of knot boxes.
Figure 1B:
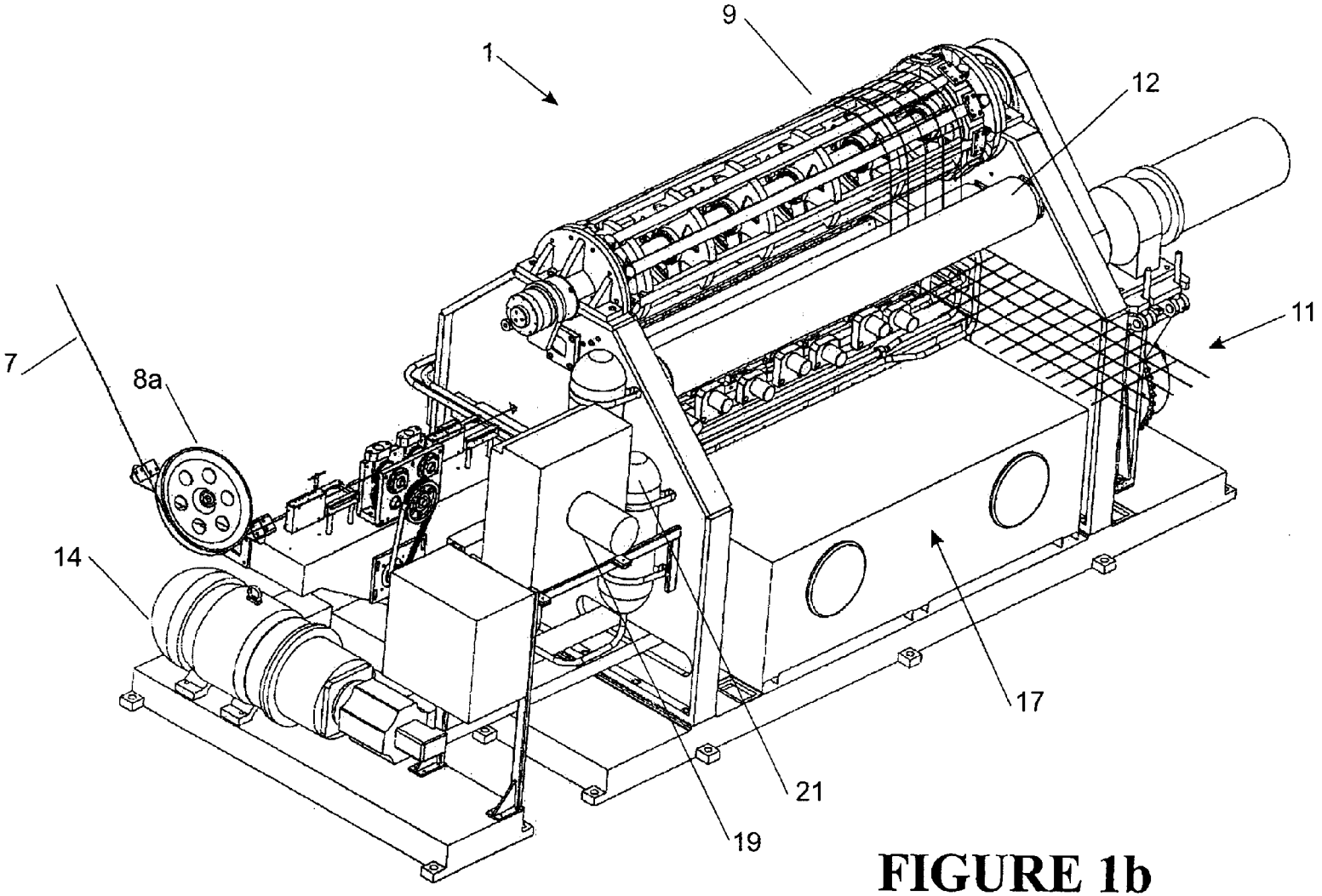

With reference to FIG. 1, a knotted fence mesh forming machine is indicated generally by reference numeral 1.

FIG. 1 a shows a number of continuous line wires 2 and knot wires 3 being fed to a bed 4 of the machine 1, which bed has a plurality of side by side knot boxes 5. The line wires 2 enter the machine at its base, are turned through 90 degrees around rollers 6 and pass vertically through the knot boxes 5. One line wire 2 and one knot wire 3 pass through each knot box 5 with different orientations as will be described below with reference to FIG. 6. A continuous stay wire 7 is projected across the bed of the machine via a system of driven rollers 8 and a free-running guide sheave 8*a* so as to transversely cross each of the knot boxes 5, thereby forming a plurality of stay wire-line wire intersections.

It will be appreciated that the line wires 2 are those which will extend generally horizontally when a fence mesh is set in position between fence posts, and the stay wires 7 are those which extend laterally across the line wires at regular spacings.

The machine 1 has a main drive roller 9 which pulls the completed fence mesh through the knot boxes 5, the drive roller being driven by an electric motor 10. The completed fence mesh (indicated generally by reference numeral 11 in FIG. 1*b*) then extends around a further roller 12, and would typically extend to a coiling machine or take-up unit (not shown) to form it into a coil for ease of handling and transportation.

The knotted fence mesh forming machine 1 generally has a step-wise operation and forms a series of knots along the length of stay wire 7 at each line wire-stay wire intersection at each step or "beat" of the machine. At each step or beat the line wires 2 are advanced forward in parallel through the side by side knot boxes 5 in the machine bed 4 via the drive roller 9, a stay wire 7 is fed into the bed 4 of the machine across the line wires at the knot boxes 5, at 90° for forming square fence mesh as shown, a length of the stay wire 7 is cut, and simultaneously in each knot box 5 at each intersection between the line wires and the stay wire a knot securing the stay wire to the line wire is formed.

It will be understood that the relative orientations of the wires may be varied depending on the type of fence mesh required, and the details of the knot boxes 5 will vary depending on the type of knots and fence mesh required. Operation of one preferred type of knot box will be described with reference to FIGS. 2 to 8.

Knot boxes in knotted fence mesh forming machines are conventionally actuated using mechanical means. In accordance with a preferred embodiment of the present invention, the knot boxes 5 are actuated by a hydraulic drive system. Accordingly, the machine 1 includes an electric motor 14 driving a hydraulic pump 15, as well as a reservoir 17 for storing hydraulic fluid. A cooling fan 19 and hydraulic accumulators 21 are also provided. Further details of the hydraulic actuation of the knot boxes 5 will be described below.

FIG. 2 shows schematically a preferred method for forming a knot around a line wire-stay wire intersection. With reference to FIG. 2*a*, in the first step of the method, an intersection is formed between a line wire 2 and a stay wire 7 which cross transversely. The stay wire 7 is supported against the line wire 2 in a notch 21 of a first support, which in this embodiment is a line wire-stay wire support 20. A knot wire 3 is provided to extend at an angle across the line wire-stay wire intersection.

Figure 2A:
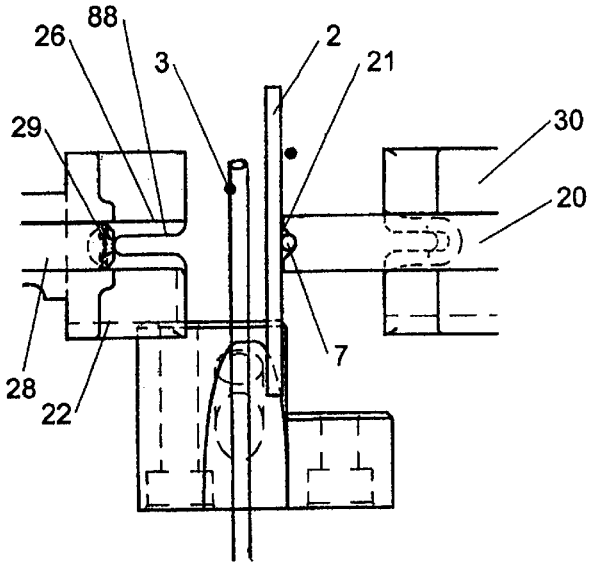
FIG. 2 shows schematically a method of forming a knot around a wire junction in accordance with a preferred embodiment of the present invention.
Figure 2B:
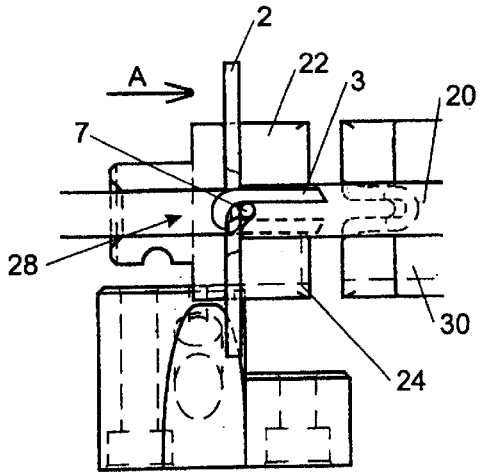

In the second step of the method, as shown in FIG. 2*b*, a first former which in this embodiment is a staple former 22 moves in the direction indicated by Arrow A towards the line wire-stay wire intersection from the side opposite the line wire-stay wire support 20, shears a length of the knot wire 3, and bends the cut length of knot wire around the line wire-stay wire intersection to form a staple around the intersection. The staple former 22 includes a cutting edge 24 (shown in hidden detail in FIG. 2*b*, and more clearly in FIG. 7) to shear the knot wire, and a generally U-shaped forming surface 26 to bend the cut length of knot wire into a staple around the line wire-stay wire intersection. Movement of the line wire-stay wire intersection away from the knot wire 3 during staple forming is prevented by the line wire-stay wire support 20. Simultaneously with the forward movement of the staple former 22, a second support which in this embodiment is a staple support 28 also moves forward in the direction indicated by Arrow A to support the bow of the bent knot wire 3 within a notch 29 in the staple support 28. The line wire-stay wire intersection is at this time still supported by the line wire-stay wire support 20.

Figure 2C:
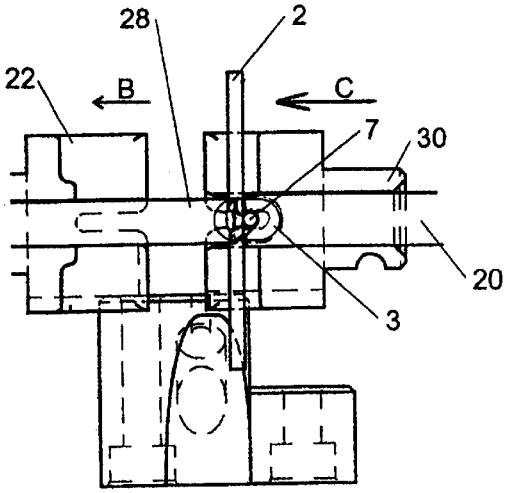

As shown in FIG. 2*c*, the staple former 22 then moves away from the wire intersection in the direction indicated by Arrow B, while a second former which in this embodiment is a final former 30 moves in the direction indicated by Arrow C towards the wire intersection. The final former 30 also includes a generally U-shaped forming surface 32 which bends the ends of the cut length of knot wire 3 and wraps these around the stay wire 7. It will be appreciated that configuration of the forming surface 32 in the final former 30 could be altered to wrap the legs of the staple around the line wire 2 rather than the stay wire 7, although this would require a more complex forming surface shape. Alternatively, the line wire and the stay wire could be swapped in the knot box for this purpose.

Figure 2D:
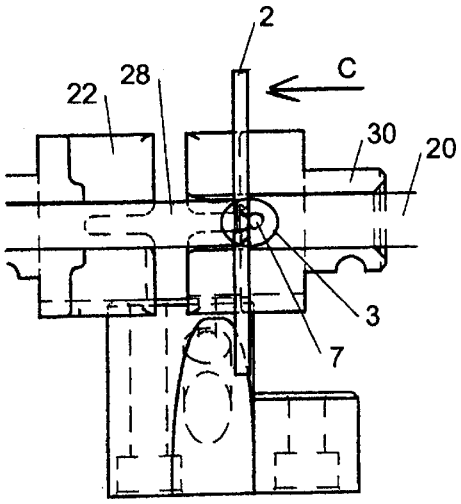

FIG. 2*d* shows the final knot formed around the line wire-stay wire intersection. Once the final knot has been formed, the final former 30, line wire-stay wire support 20 and staple support 28 can all move away from the knot, allowing the line wires 2 to be moved longitudinally to begin the next forming step.

Figure 3A:
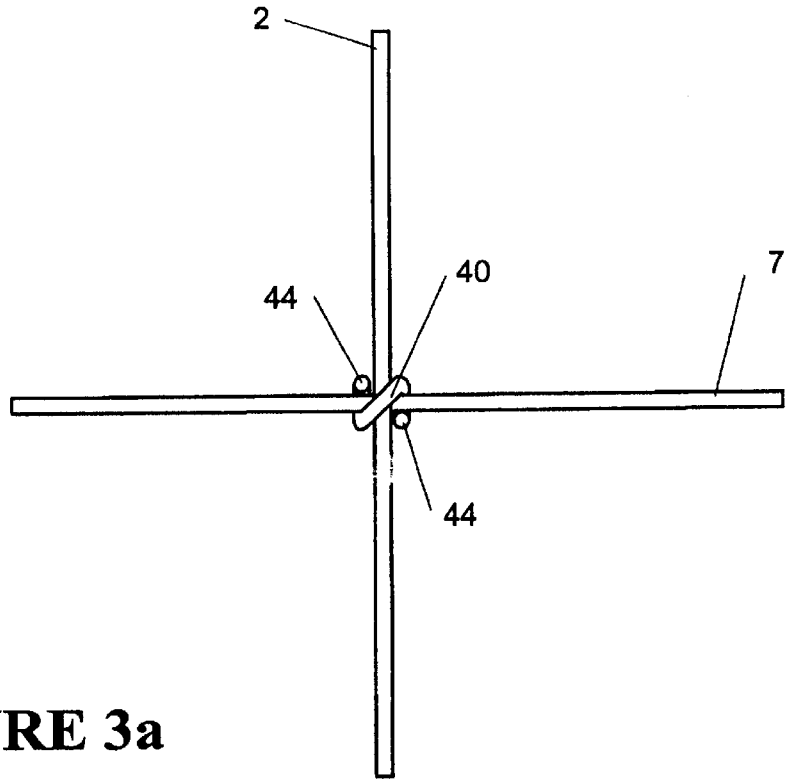
FIG. 3 shows opposite sides of a knot formed by the method described with reference to FIG. 2.
Figure 3B:
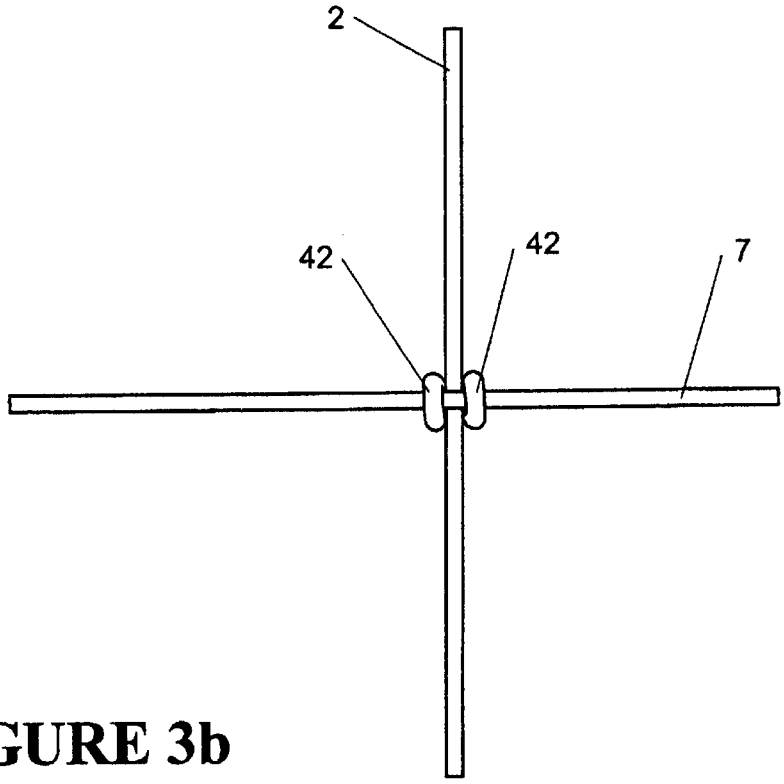

As shown in FIG. 3, the final knot has a bow portion 40 which is seated against the line wire 2 and extends diagonally around the line wire-stay wire intersection. The legs 42 of the final knot extend back around the stay wire 7 in opposite directions substantially parallel to each other, toward the bow portion 40. The ends 44 of the legs 42 are flat and substantially flush with the line wire 2, and have no protruding sharp edges. Therefore, the knot will not snag or cut the fur or flesh of an animal if it comes into contact with the ends 44 of the legs 42. The knotted wire mesh is also safer for handling during installation than conventional knotted wire mesh, due to a lack of sharp edges.

Figure 4:
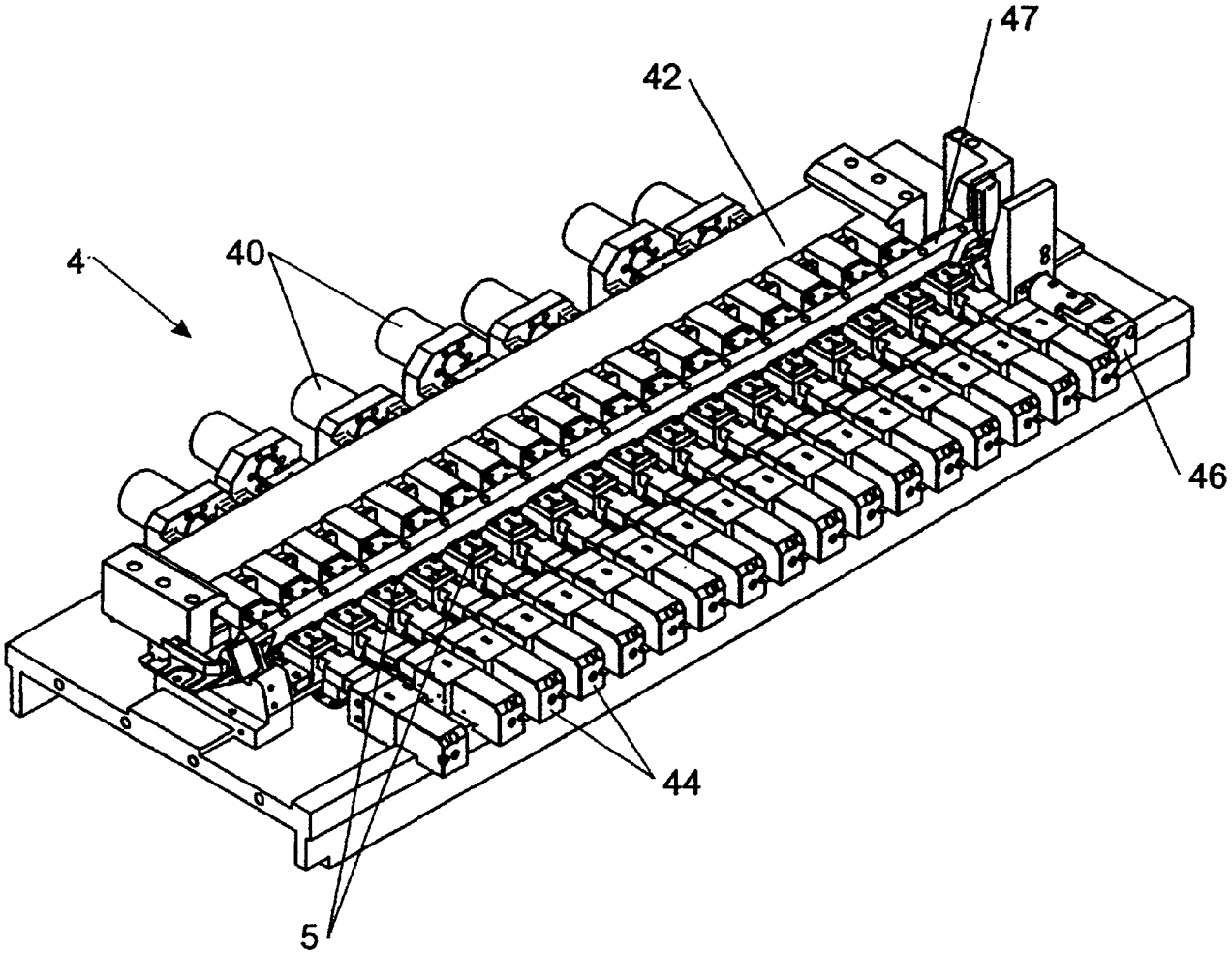
FIG. 4 shows a perspective view of the bed of the machine of FIG. 1 with a drive system in accordance with a preferred embodiment of the present invention.

The machine bed 4 with a plurality of preferred knot boxes 5 and the associated drive mechanisms is shown in FIG. 4. The plurality of knot boxes 5 are located in side by side configuration. A plurality of hydraulic cylinders 40 are provided to drive a push bar assembly 42. The push bar assembly 42 includes two independently actuable bars (shown in FIG. 5), one of which is in operable connection with staple former and the other of which is in operable connection with staple supports, as will be described with reference to FIGS. 5 and 6. Each alternate cylinder 40 drives one of the independently actuable bars, while the other cylinders drive the other bar, providing a substantially even force along the length of the bars. A plurality of hydraulic double cylinders 44 are provided to independently actuate each final former and line wire-stay wire support, as described herein below.

As mentioned above in relation to FIG. 1, the stay wire 7 is propelled across the knot boxes. A hydraulically-actuated stay wire placer assembly 46 may be provided to locate and grip the stay wire 7 across the knot boxes 5 prior to forming of the knots. The placer assembly 46 includes a stay wire placer bar 47 to locate the stay wire 7 in the required position. However, the stay wire placer bar 47 is not essential to the functioning of the machine, and is has been found that the stay wire 7 can be positioned in a satisfactory manner without using the placer bar 47. The stay wire 7 is cut to the required length as it is placed in position, prior to the knots being formed.

It will be appreciated that the stay wire 7 will be wrapped around the end line wires 2 in the completed fence mesh. This is achieved through the use of twister units, which are common to fence machinery. The operation of such twister units will be understood by a person skilled in the art, and will not be described further here.

An alternative drive system will be described below with reference to FIGS. 10 and 11.

Figure 5:
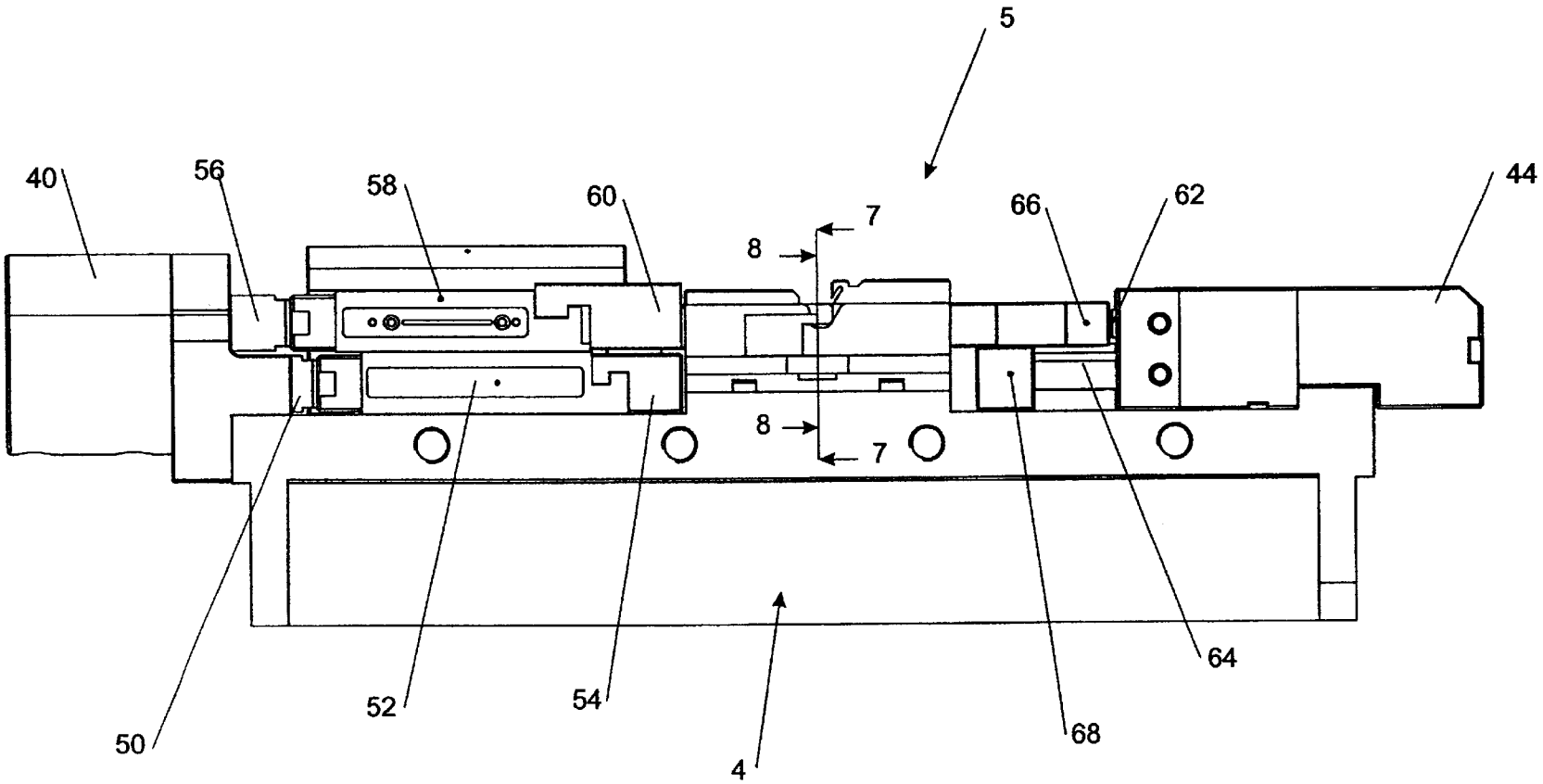
FIG. 5 shows an external side view of one of the knot boxes of FIG. 4.
Figure 6:
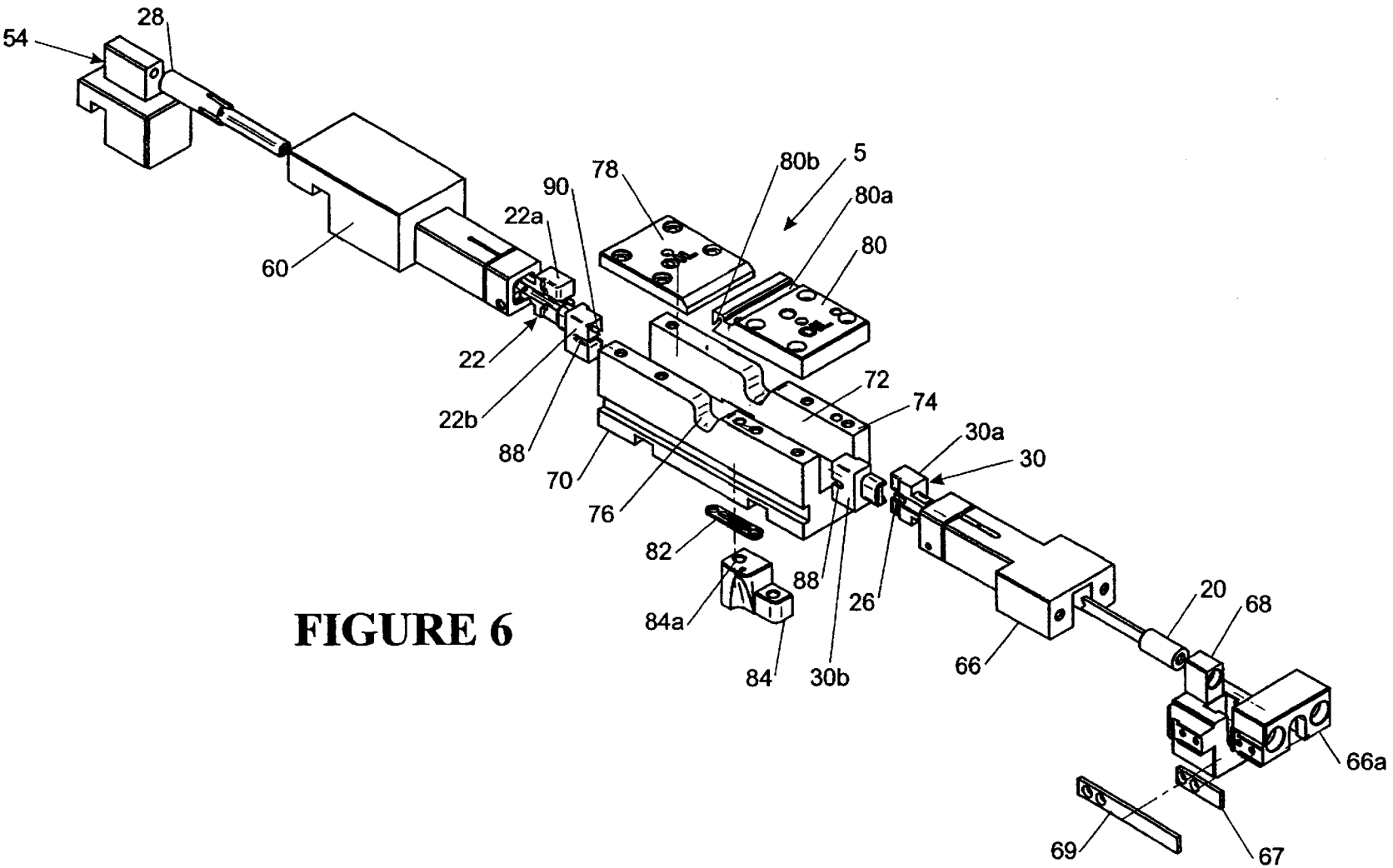
FIG. 6 shows an exploded perspective view of the components of one of the knot boxes of FIG. 4.

With reference to FIG. 5, each alternative hydraulic cylinder 40 has a ram 50 which drives a staple support drive bar 52 which is attached to brackets of a plurality of staple support holders 54, each of which staple support holders 54 holds a staple support (see FIG. 6). The other hydraulic cylinders (which are not visible in the Figure) each have a ram 56 which drives a staple former drive bar 58 which is attached to brackets of a plurality of staple former holders 60, each of which staple former holders 60 holds a staple former (see FIG. 6).

The staple support drive bar 52 is elongate and extends the width of all of the knot boxes 5 on the machine bed 4, so that all staple supports are moved simultaneously upon movement of the staple support drive bar 52. Similarly, the staple former drive bar 58, while being actuable independently of the staple support drive bar 52, also extends the width of all of the knot boxes 5 so that all staple former are moved simultaneously upon movement of the staple former drive bar 58.

Alternatively, the staple supports and/or staple former could be driven independently, preferably through the use of hydraulic double cylinders, in a similar manner to that described below with reference to the final former and line wire-stay wire supports.

Each hydraulic cylinder 44 on the opposite side of the machine bed has two independently actuable rams 62, 64. One of the rams 62 drives a final former holder 66 which holds a final former (see FIG. 6), while the other ram 64 drives a line wire-stay wire support holder 68 which holds a line wire-stay wire support (see FIG. 6). Each knot box has its own hydraulic cylinder 44, meaning that each final former and line wire-stay wire support is actuable independently of all the others. It has been found that utilizing individual hydraulic cylinders to actuate the final former and line wire-stay wire supports independently provides even pressure for the final forming of each knot, resulting in very tight and strong knots being formed.

Alternatively, the final former and/or line wire-stay wire supports could be driven simultaneously by hydraulic cylinders linked by drive bars, in a similar manner to that described above with reference to the staple supports and staple former.

As shown in FIG. 6, each knot box 5 includes a slide box 70 within which the knot is formed. The slide box includes a main longitudinal through channel 72 formed between two side walls 74 within which channel the staple former 22 and final former 30 are slidably movable. The staple former holder 60 and final former holder 66 each include a narrow body part and a wide body part, the narrow body part of each being sized to slidably fit within the channel 72. The transition between the narrow body part and wide body part on each of the staple former holder 60 and the final former holder 66 forms a stop, which prevents the staple former and final former from moving too far inwardly within the slide box 70.

A bracket part 66*a* is provided to connect the final former holder 66 to its respective ram 62 of the hydraulic cylinder 44 (shown in FIG. 5). A short sensor finger 67 extends outwardly from the bracket part 66*a*, and a long sensor finger 69 extends outwardly from the line wire-stay wire support holder 68.

The top central portion of each side wall 74 of the slide box includes an arcuate recess 76, through which the stay wire (not shown) extends in use. Two retainer plates 78, 80 are removably attached to the tops of the side walls 74, and are sized such that there is a transverse space between the retainer plates 78, 80 corresponding to the position of the recesses 76. This allows the stay wire and the knotted fence mesh to be moved upwardly out of the recesses 76 once a row of knots has been formed.

A groove 80*a* is provided in the top of the retainer plate 80. This groove provides clearance for the stay wire placer bar 47 as it pivots forward to place the stay wire. A downwardly-angled slot 80*b* is provided in an end of the retainer plate 80. As the stay wire is projected across the bed of the machine, it extends through the slots 80*b*. These slots provide guidance for the stay wire, which is moved downwardly at an angle out of the slots to form the wire intersection. This feature isn't essential, as the stay wire 7 can be projected through the arcuate recesses 76 of the slide boxes and then pushed forwards into position.

The base of the slide box 70 includes a central aperture (not shown) through which a knot wire and stay wire extend in use. A wire centering insert 82 is provided to align the line wire 2 as it enters the slide box 70. A knot wire insert 84 is also provided, and is shown in more detail in FIG. 7. The knot wire insert 84 has a through aperture 84*a* having an alignment corresponding to the desired alignment of the knot wire 3 relative to the staple former 22. The knot wire 3 is fed into the slide box 70 through the aperture 84*a* in the knot wire insert 84.

The staple former 22 and final former 30 each comprise two parts 22*a*, 22*b* and 30*a*, 30*b* respectively. The staple former holder 60 and staple former 22 are hollow to allow the staple support 28 to slidably move therein. Similarly, the final former holder 66 and the final former 30 are hollow to allow the line wire-stay wire support 20 to slidably move therein.

Figure 7:
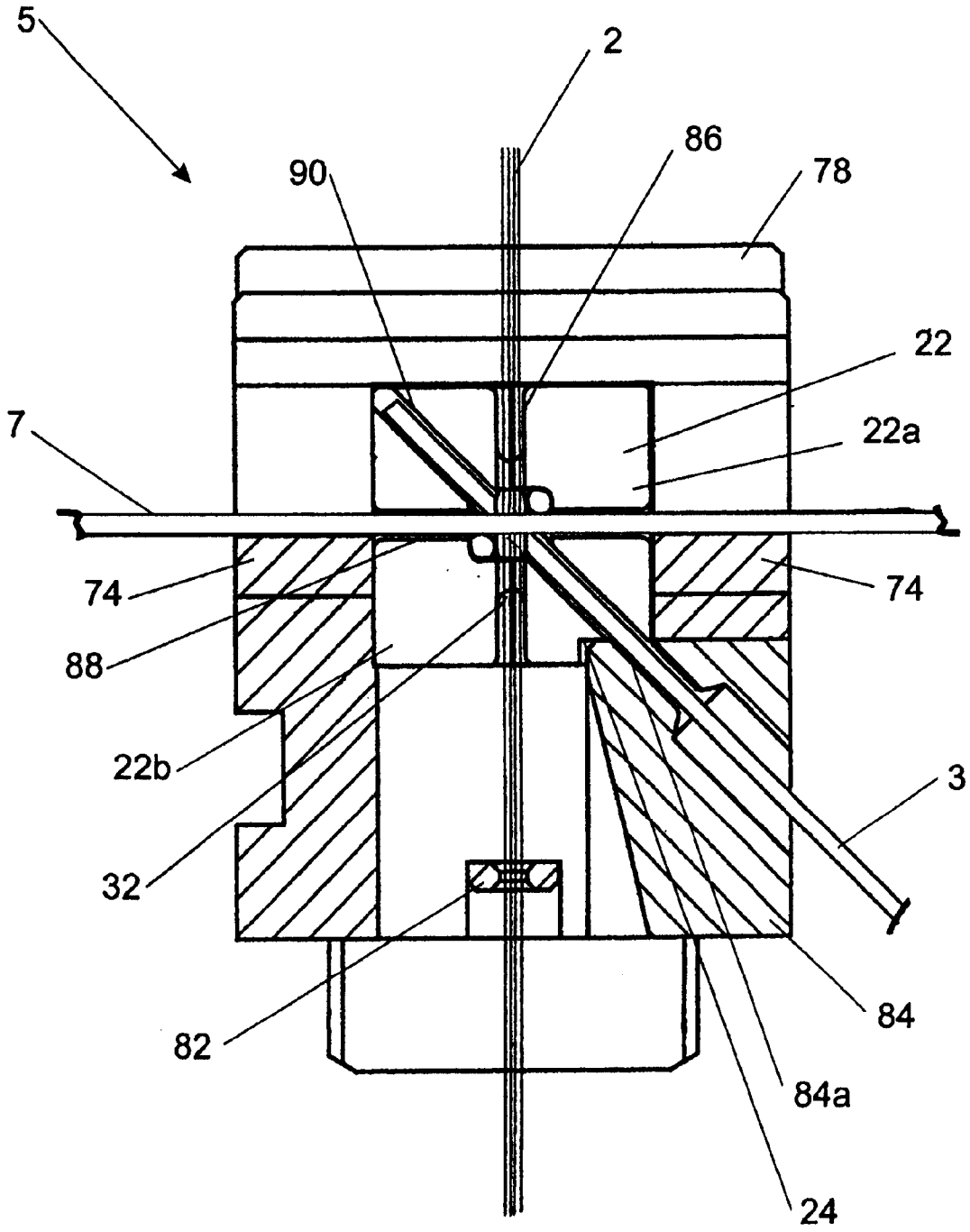
FIG. 7 shows a transverse sectional view of the interior of a knot box along line 7—7 of FIG. 5, with the wires in position ready for knot forming.

As shown in FIG. 7, when the halves of the staple former 22 are adjoined, they provide a vertical slot 86 for receipt of the vertical line wire (orientation with respect to the drawing) as well as a horizontal slot 88 for receipt of the horizontal stay wire (orientation with respect to the drawing) when the staple former 22 is in its forwardmost position within the channel 72. The central portion of the staple former 22 also provides an enlarged generally U-shaped forming surface 26 for bending the knot wire, as will be more readily apparent from FIG. 2*a*.

Figure 8:
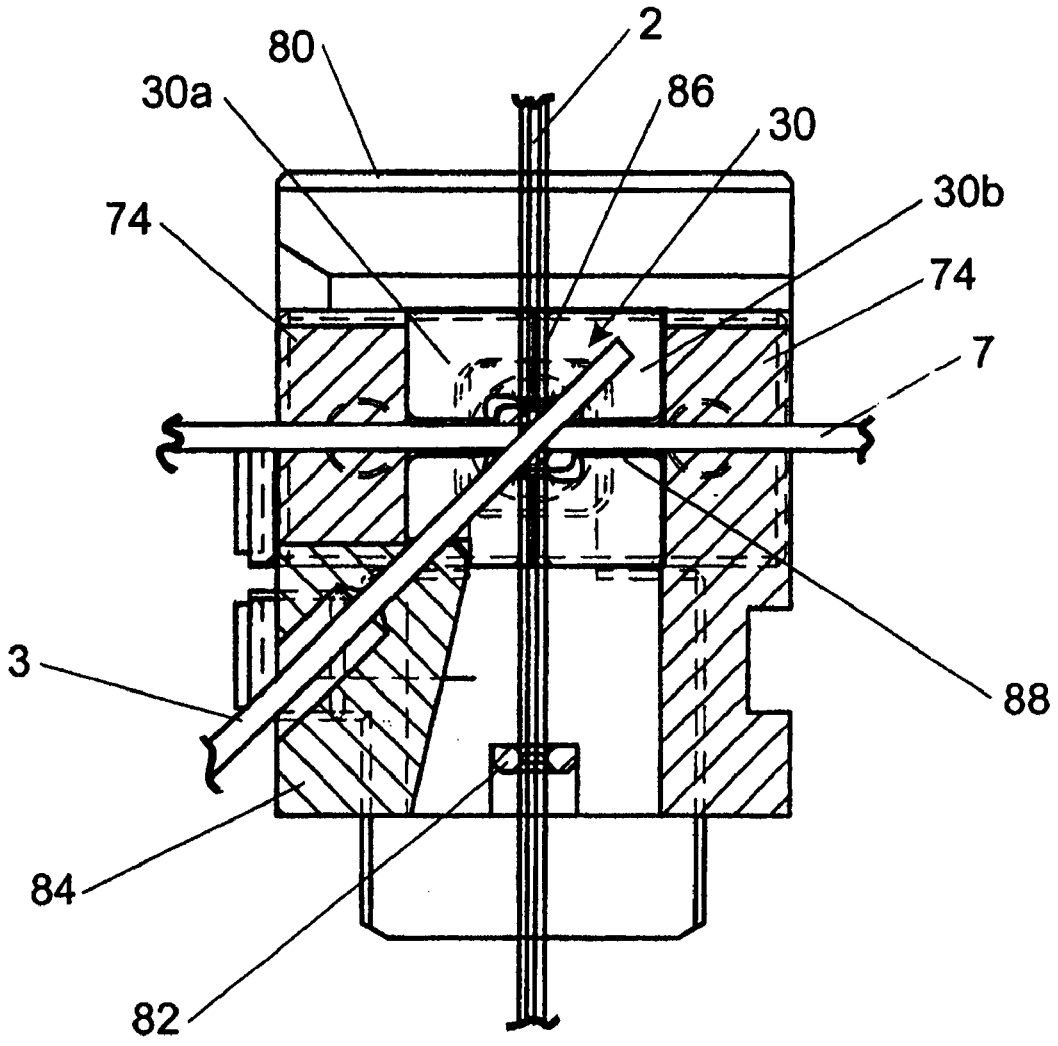
FIG. 8 shows a transverse sectional view of the interior of a knot box along line 8—8 of FIG. 5, with the wires in position ready for knot forming.

Similarly, as shown in FIG. 8 when the halves of the final former 30 are adjoined, they also provide a vertical slot 86 for receipt of the vertical line wire as well as a horizontal slot 88 for receipt of the horizontal stay wire when the final former 30 is in its forwardmost position within the channel 72. The central portion of the final former 30 also provides an enlarged generally U-shaped forming surface 32 for contacting and bending the legs of the knot wire back around the stay wire, as will be apparent from FIG. 2*b*.

As shown in FIG. 6, the front face of the staple former 22 includes a diagonal groove 90, which corresponds to the position of the knot wire prior to it being bent around the line wire-stay wire intersection. As can be readily seen from FIG. 7, the diagonal groove 90 is present in both halves 22*a*, 22*b* of the staple former.

The staple former parts 22*a*, 22*b* and final former parts 30*a*, 30*b* can be easily removed from their respective holders for replacement as they wear down.

FIG. 9 is similar to FIG. 2, but shows additional details of the components of the preferred knot boxes.

Figure 9A:
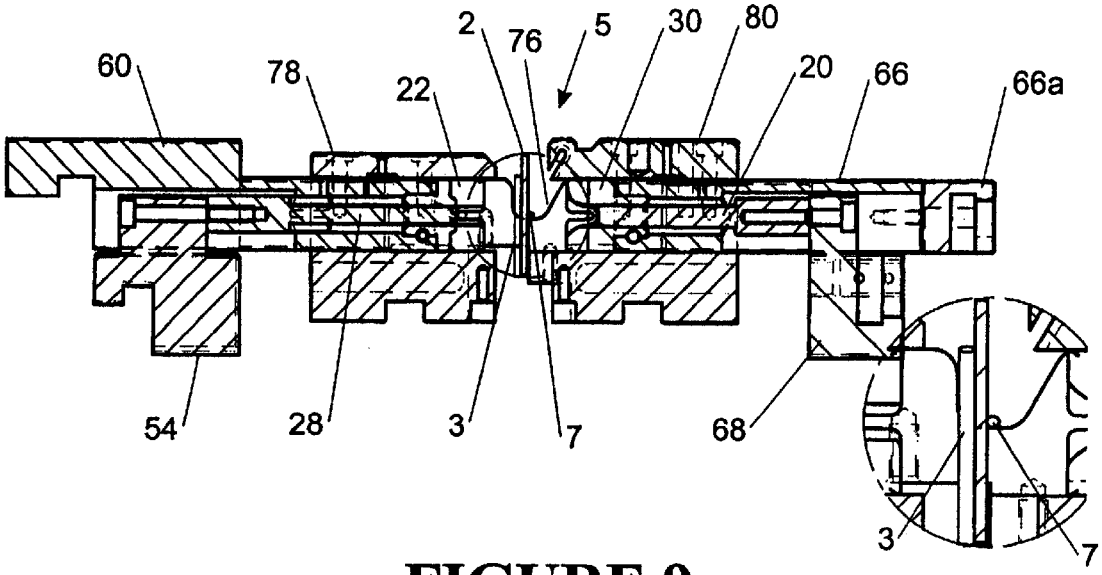
FIG. 9 shows longitudinal sectional views of one of the knot boxes of FIG. 4, showing the steps of forming a knot at a wire junction.

In FIG. 9*a*, the line wire 2 and stay wire 7 are formed into an intersection within the knot box 5, and the knot wire 3 is provided across the intersection at an angle to the line wire 2 and stay wire 7. The line wire 2 extends vertically through the knot box 5, whereas the stay wire 7 extends transversely across the knot box through the arcuate recesses 76 in the side walls 74, and is located against the base parts of the arcuate recesses 76. The line wire-stay wire support 20, staple former 22, staple support 28 and final former 30 are all shown in their outermost positions, and are all clear of the line wire-stay wire intersection.

Figure 9B:
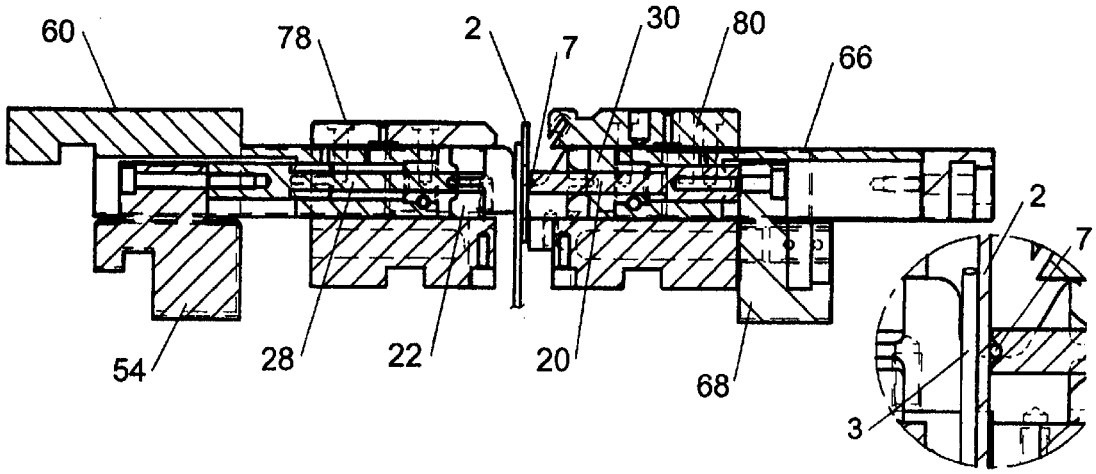

In FIG. 9*b*, the line wire-stay wire support 20 has been moved inwardly, via the line wire-stay wire support holder 68 and hydraulic ram 64 (FIG. 5) to support the stay wire 7 against the line wire 2.

Figure 9C:
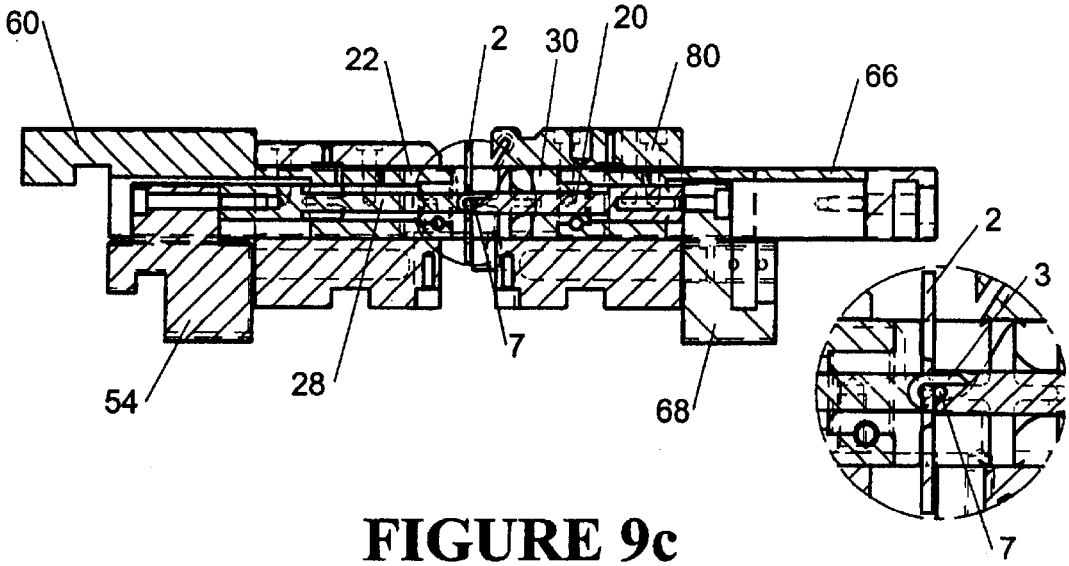

The staple support 28 and staple former 22 are then moved inwardly simultaneously via the respective rams 50, 56, the respective drive bars 52, 58, and the respective holders 54, 60 to bend the knot wire 3 around the line wire-stay wire intersection as shown in FIG. 9*c*. As the staple former 22 moves towards the inward position, the knot wire 3 is initially received in the diagonal groove 90 of the staple former and is sheared by an edge 24 of the staple former 22. As the staple former moves further inwardly, the knot wire is bent by the generally U-shaped forming surface 26 into a staple around the line wire-stay wire intersection. In the forwardmost position of the staple former 22, the line wire 2 is located in the vertical slot 86 of the staple former 22 and the stay wire 7 is located in the horizontal slot 88 of the staple former 22 (slots are shown in FIG. 7). The formed staple and the line wire-stay wire intersection are held between the line wire-stay wire support 20 and the staple support 28.

While the staple support 28 is described as moving forward concurrently with the staple former 22, it will be appreciated that it could be moved independently.

Figure 9D:
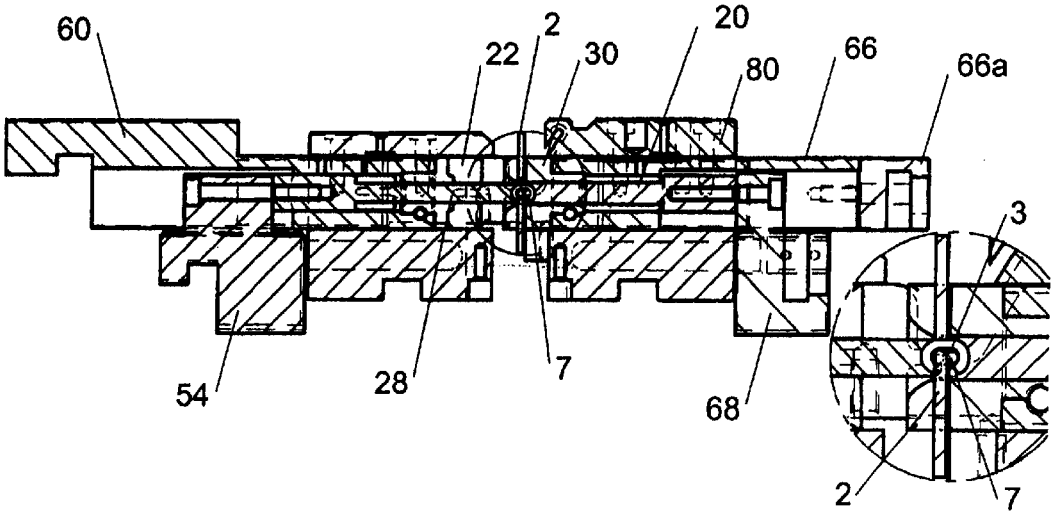

The staple former 22 is then moved outwardly away from the line wire-stay wire intersection while, via the ram 62, bracket part 66A and final former holder 66, the final former 30 is moved inwardly towards the line wire-stay wire intersection to the position shown in FIG. 9*d*. The generally U-shaped forming surface 26 of the final former 30 bends the ends of the staple around the stay wire 7 to form the final knot. When the final former 30 is in the position shown in FIG. 7*d*, the line wire 2 is located the vertical slot 86 of the final former and the stay wire 7 is located in the horizontal slot 88 of the final former.

The line wire-stay wire support 20, staple support 28, and final former 30 are all then moved outwardly away from the line wire-stay wire intersection to enable the completed row of knots to be pulled upwardly. The sensor fingers 67, 69 indicate to a programmable logic controller that the final former 30 and line wire-stay wire support 30 have reached the outermost position, at which time the completed row of knots is moved upwardly out of the knot boxes 5. The process is then repeated to form the next row of knots.

Figure 10:
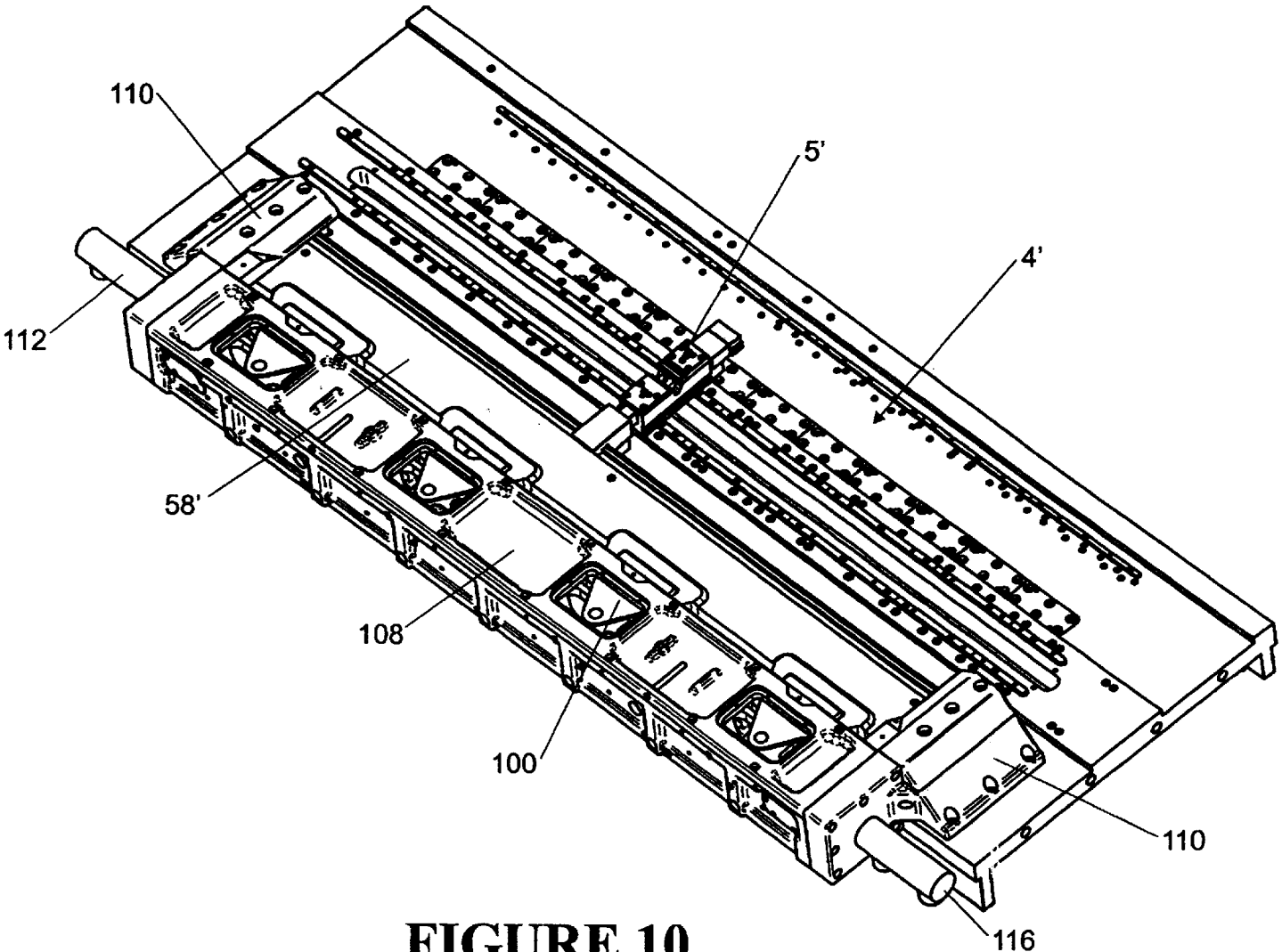
FIG. 10 shows a perspective view of a machine bed having an alternative drive system in accordance with a preferred embodiment of the present invention, the drive system including a rack bar.
Figure 11:
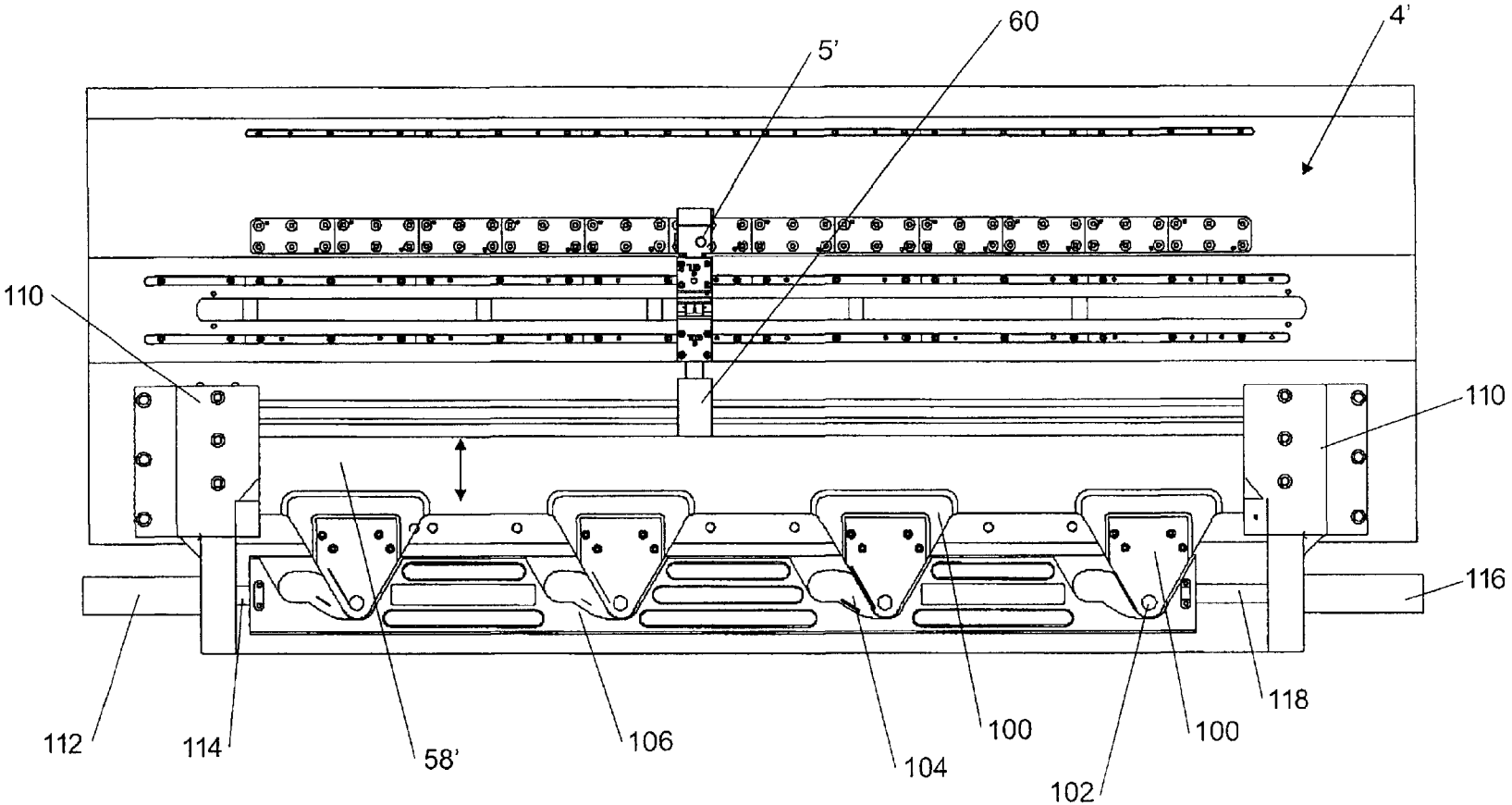
FIG. 11 shows a partial sectional plan view of the drive system of FIG. 10.

FIGS. 10 and 11 show a modified machine bed 4' with an alternative hydraulic drive system. For the purpose of clarity, only a single knot box 5' is shown on the machine bed 4', and the drive mechanism is only shown on one side of the machine. The knot boxes 5' are preferably the same as the knot boxes 5 described above, but the drive system may be used with different knot boxes.

As with the system illustrated in FIG. 5, the staple former and staple supports are driven by independently actuable drive bars, although only one drive bar 58' is visible in FIGS. 10 and 11. This drive bar 58' is attached to brackets of a plurality of staple former holders 60 (as shown in FIG. 6). A further drive bar is present beneath the staple former drive bar 58', the further drive bar being attached to brackets of a plurality of staple support holders 54 (as shown in FIG. 6). The staple former drive bar 58' has a plurality of cam followers 100 extending therefrom, each cam follower including a roller 102 which engages the camming surface of one of a plurality of cam pockets 104 of a rack bar 106. The rack bar 106 is transversely (relative to the direction of the knot box 5') slidably mounted in a housing 108. Movement of the drive bar 58' is guided by a pair of guide brackets 110.

A hydraulic cylinder 112 is mounted to an end of the housing 108, and a ram 114 of the hydraulic cylinder is attached to the rack bar 106. When the rack bar is in the left-most position shown in FIG. 11, the rollers 102 of the cam followers 100 are located in the most rearward portion of each cam pocket 104, and the drive bar 58' is in the withdrawn position such that the staple former are in the withdrawn positions within each knot box 5'. When the hydraulic cylinder 114 is actuated, the ram 114 pushes the rack bar 106 to the right and the cam rollers 102 thereby move forwards within the cam pockets 104. This forward movement translates into forward movement of the drive bar 58', which movement is guided by the guide brackets 110. The forward movement of the drive bar 58' causes the staple former to move inwardly in the knot boxes 5'.

When it is desired to retract the staple former, the hydraulic cylinder 112 is actuated to retract the ram 114, which moves the rack bar 106 back to the left, causing the cam rollers 102 to move back to the rearward position in the cam pockets 104, thereby moving the drive bar 58' rearwardly.

Although not apparent from the Figures, the staple supports are actuated in a similar way by a further rack bar and drive bar which are located below the rack bar 106 and drive bar 58', and which are actuated by a further hydraulic cylinder 116 and ram 118.

It will be appreciated that the final former and/or line wire-stay wire supports may additionally or alternatively be driven simultaneously by drive bars, in a similar manner to that just described with reference to FIGS. 10 and 11.

An advantage of the drive system shown in FIGS. 10 and 11 over that shown in FIGS. 4 and 5 is that the rack bars and cam followers ensure that the drive bar is pushed forwards in an exactly perpendicular manner.

Rather than, or in addition to, using a hydraulic drive system to move the former and/or supports, some or all of the former and supports may be hydraulically damped to provide even pressure to each knot. For example, one or more of the line wire-stay wire supports, staple supports, staple former and final former may be driven either mechanically or by means of linked or independent hydraulic cylinders, whilst additionally being hydraulically loaded.

Figure 12:
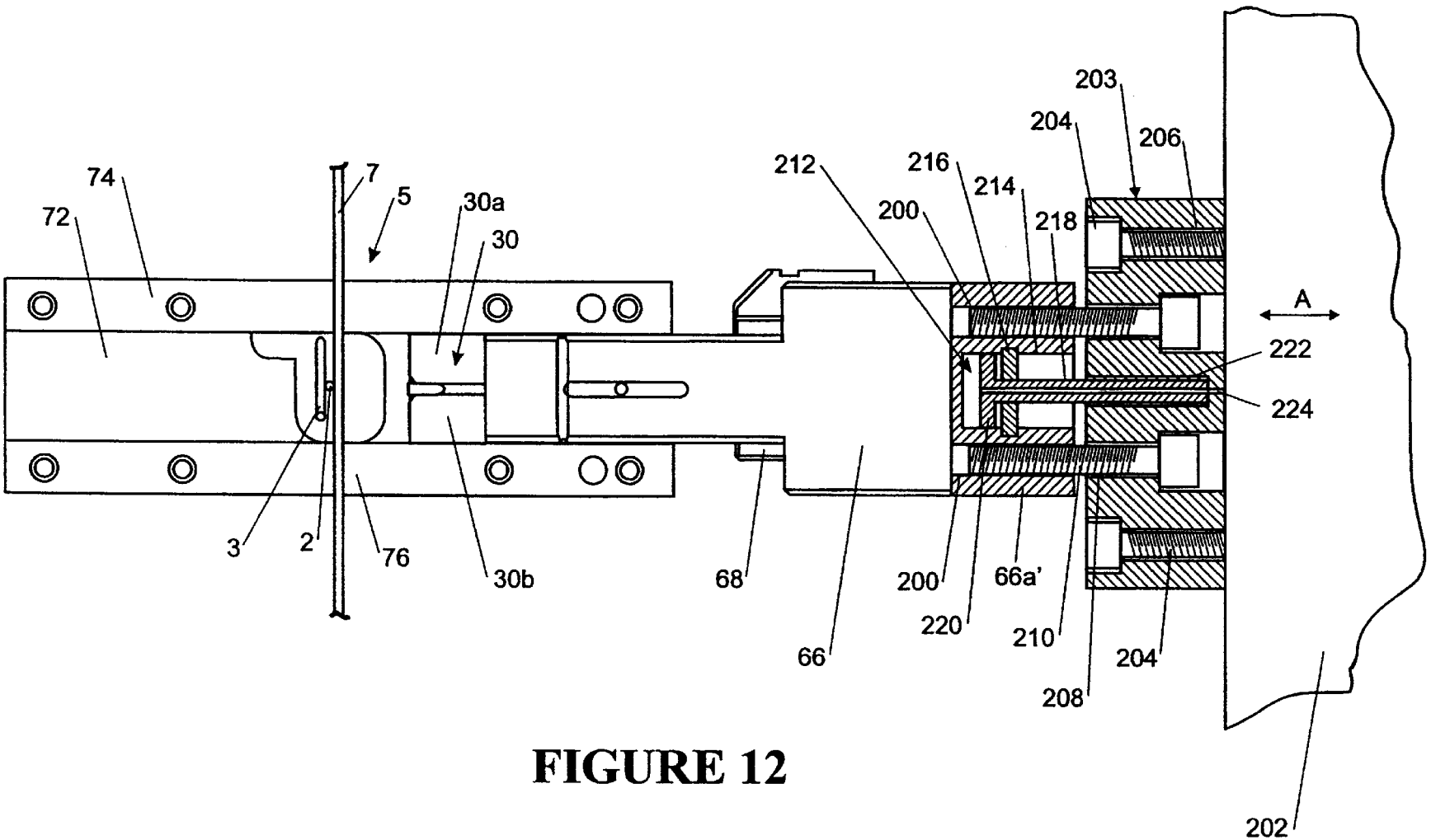
FIG. 12 shows a plan view of an alternative drive arrangement using a drive bar and a hydraulic damping cylinder in a tool holder bracket, the sections of the tool holder relating to the damping cylinder being shown in cross section.

FIG. 12 schematically shows an embodiment of a knot box in which the final former is driven by a drive bar, either mechanically or hydraulically, and the final former is hydraulically damped. Unless otherwise specified, the features of the embodiment shown in FIG. 12 are similar to those described above, and like reference numerals are used to indicate like parts. It will be understood that the hydraulic damping could be used with other types of knot boxes.

FIG. 12 is a partial sectional plan view, the parts of the machine including the hydraulic damping cylinder being shown in cross section so that they can be seen in detail.

A final former holder 66 holds the final former 30 as described above, and is mounted for sliding movement in the channel 72 of the knot box 5. The final former holder 66 includes a bracket part 66*a*' which is fixedly attached to the final former holder 66 by fasteners (not shown). One of the main differences of the bracket part 66*a*' is that it includes a hydraulic damping cylinder as will be described below. A pair of spaced apart bores 200 extend into the bracket part 66*a*' from the end opposite to the end which is attached to the final former holder 66. It will be appreciated that a separate bracket part 66*a*' is not essential, and the final former holder 66 can be modified to include the hydraulic damping cylinder.

A drive bar 202 is configured for movement in a direction toward and away from the knot box 5. A tool holder attachment part 203 is rigidly attached to the drive bar via cap screws 204 extending through bores 206. The tool holder attachment part 203 includes two further bores 208 which correspond in position to the bores of the bracket part 66*a*' of the tool holder 66. A pair of cap screws 210 extend from the tool holder attachment part 203 into the bores 200 of the bracket part 66*a*'. The cap screws 210 are threadably engaged in the bores 200 of the bracket part 66*a*', but may slide within the bores 208 in the tool holder attachment part 203, to allow movement of the tool holder attachment part 203 towards the bracket part 66*a*'. Movement of the tool holder attachment part 203 away from the bracket part 66*a*' is limited by the heads of the cap screws 210 engaging shoulders in their respective bores 208.

A hydraulic damping cylinder is indicated generally by reference numeral 212, and is present in the bracket part 66*a*' of the final former holder 66. The damping cylinder is defined by a bore 214 in the bracket part 66*a*', the bore having one open end facing the tool holder attachment part 203 and the drive bar 202, and a closed end. The bore includes an annular groove in which a seal 216 is located. Extending through an aperture in the seal is a piston 218, at one end of which is a unitary flange 220 located between the seal and the closed end of the bore.

The opposite end of the piston is received in a bore 222 in the tool holder attachment part 203, and is affixed thereto. As can be seen from the Figure, the piston is hollow, so that hydraulic fluid may pass therethrough from a duct 224 extending from the end of the bore 222 in the tool holder attachment part 203 to the section of the bore 214 located between the seal 216 and its closed end. The cylinder 212 is pressurized to constant hydraulic pressure by a reservoir and accumulator (not shown) which pass hydraulic fluid into the cylinder 212 through the duct 224 and the center of the piston 218.

It can be seen that clearance is provided between the tool holder attachment part 203 and the bracket part 66*a*' when the drive bar 202 (and the final former 30) is in the retracted configuration. The pressure in the hydraulic cylinder 212 is set such that as the drive bar 202 is driven forward toward the knot box 5, initially the piston 218 will not move relative to the bracket part 66*a*', and the final former 30 will move toward the wire intersection. The drive bar is adapted to over-stroke by a small distance, so that once the final former has moved the desired distance towards and contacts the wire intersection, the drive bar 202 will continue to move forward. The pressure in the hydraulic cylinder 212 is set so that the flange 220 of the piston 218 will at that stage begin to move towards the closed end of the bore 214, allowing the tool holder attachment part 203 and bracket part 66*a*' to move towards each other.

This compression of the hydraulic cylinder means that bending of the knot wire around the wire intersection is damped by the movement of the piston 218 in the hydraulic cylinder 212, meaning that even pressure is provided to the knot irrespective of variables such as wear, wire diameter variations and build up of debris, without any mechanical adjustment being required.

As the drive bar 202 is retracted, initially the piston 218 extends from within the cylinder 212, and by virtue of the heads of the cap screws 210 moving a limited distance towards the shoulders in the bores 208, the tool holder attachment part 203 and the bracket part again separate to the position shown in the Figure. The heads of the cap screws 210 then engage in the shoulders in the bores 208 such that further rearward movement of the drive bar 202 causes corresponding rearward movement of the bracket part 66*a*', the final former holder 66, and the final former 30 away from the wire intersection.

Modifications may be made to the above embodiment. For example, while the piston is shown as being "T"-shaped in side elevation, and one end is affixed in a bore 222 the tool holder attachment part 203, the piston 218 could be machined as an integral part of the tool holder attachment part 203, and may be in the form of a cylinder or a solid shaft.

Rather than mounting a seal 216 in an annular groove in the bore 214 of the bracket part 66*a*', the bore 214 may have an inner surface of substantially constant radius and the seal may be in the form of a piston ring mounted on the flange 220, the seal being adapted to seal against the inner surface of the bore 214. In the alternative embodiment in which the piston is cylindrical or in the form of a shaft and machined as an integral part of the tool holder attachment portion 203, the seal could be provided in a groove in the bore 214 to seal against the outer surface of the piston, or alternatively the seal could be in the form of a piston ring mounted in a groove in the piston to seal against the inner surface of the bore 214.

Further, rather than delivering hydraulic fluid through the center of the piston 218, the flange 220 of the piston 218 may be solid and hydraulic fluid supplied directly into the cylinder 212 via a port in the bracket part 66*a*'. This option could also be used with the piston machined as an integral part of the tool holder attachment part 203, with the piston having a closed end between the seal 216 and the end of the bore 214 closest to the final former holder 66.

Figure 13:
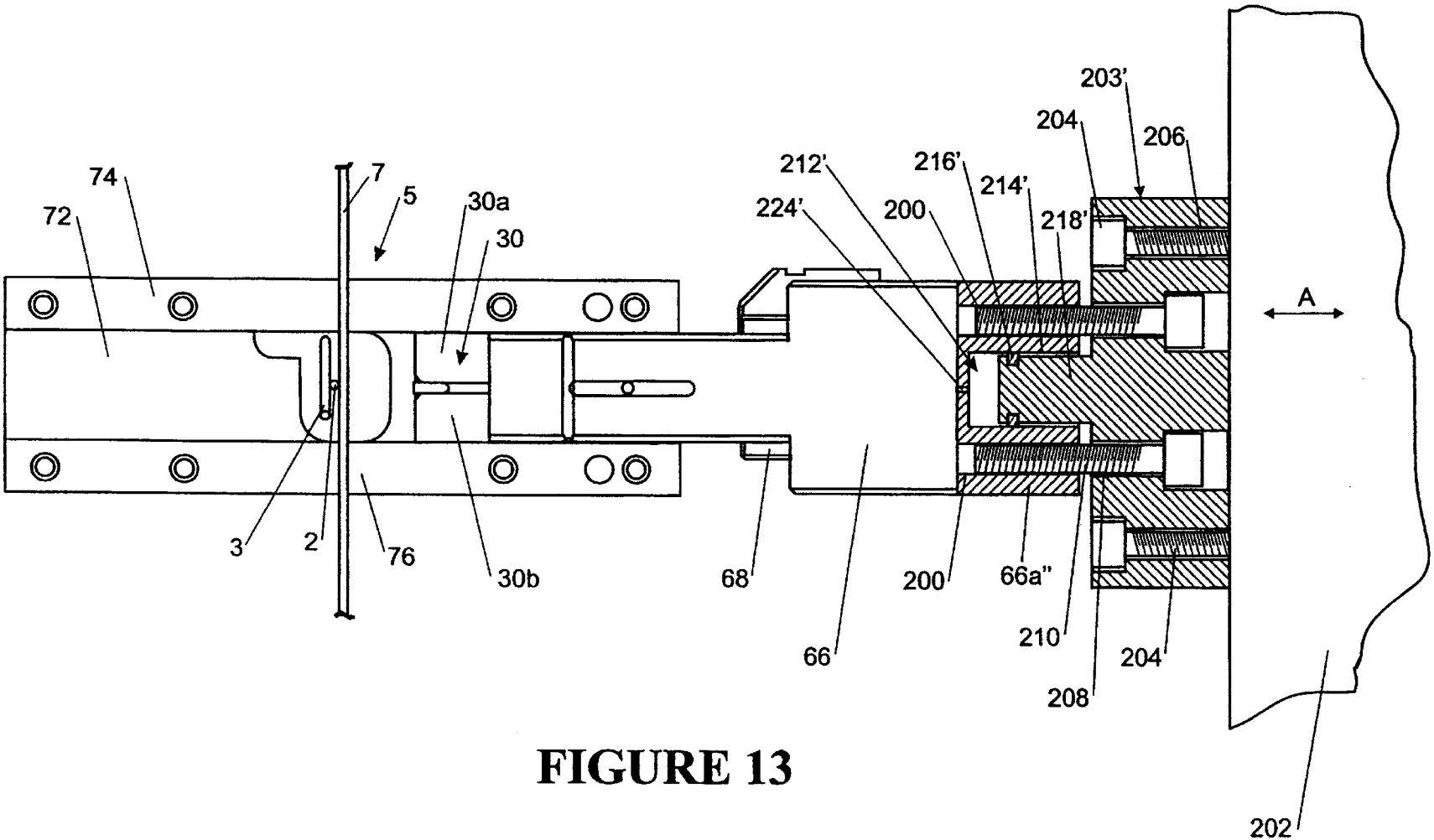
FIG. 13 shows a plan view of a further alternative drive arrangement using a drive bar and a hydraulic damping cylinder in a tool holder bracket, the sections of the tool holder relating to the damping cylinder being shown in cross section.

An alternative embodiment is shown in FIG. 13. Other than the details discussed below, the features and operation of this embodiment are as described above with reference to FIG. 12. In the embodiment of FIG. 13, the piston 218' is in the form of a solid shaft extending from the tool holder attachment part 203'. A groove is formed toward the distal end of the piston 218', and an annular piston ring seal 216'extends therefrom to seal against the inner surface of the bore 214'.

As the piston 218' is solid, hydraulic fluid is delivered directly into the cylinder 212' via a port 224' in the final former bracket part 66*a*".

An individual hydraulic cylinder may be built into each tool holder. In the preferred embodiment, the final former are hydraulically loaded in this manner, to provide even pressure for the final knot forming. However, one or more of the other former or supports may also or alternatively be hydraulically loaded in such a way.

The preferred knot box, machine and method described above have a number of advantages over those that are conventionally known.

A conventional knotted fence mesh forming machine has an operating rate of approximately 50 to 60 beats per second. It has been found that, by forming the staples around the line wire-stay wire intersections, an operating rate of 80 beats per minute is attainable.

Knotted fence mesh forming machines are conventionally mechanically actuated, meaning that each knot box of the machine must be individually adjusted and calibrated. The hydraulic cylinders used in the preferred machine are effectively self-adjusting, saving labor time and expense. Using hydraulic actuation for at least one former and/or support enables automatic compensation for variations in wire diameter, tooling wear and/or build up of wire galvanizing debris.

By independently hydraulically actuating at least the final former and/or line wire-stay wire supports, and preferably also the staple former and staple supports, even pressure is provided for the final forming of each knot, resulting in consistently strong and tight knots being formed.

Hydraulically damping some of the former offers similar advantages, whether the former are mechanically or hydraulically driven.

While preferred embodiments of the invention have been described herein, it should be appreciated that improvements or modifications thereto may be made without departing from the scope of the following claims.

For example, while the hydraulic actuation of former and/or supports in knot boxes of a fence mesh forming machine is described above with reference to a particular embodiment knot box, it will be appreciated that it will have application with other types of knot boxes.

For example, other knot boxes may only utilize a single former rather than two former, or may utilize two former which may be moved concurrently rather than one after the other. Further, one or more supports may or may not be present in the knot box. However, a skilled person will appreciate that the principle of the invention can be readily modified to fiction with alternative embodiment knot boxes.

What is claimed is:

1. A knotted fence mesh forming machine comprising a machine bed with a plurality of side by side knot boxes each for forming a knot at the intersection between a line wire and a stay wire, each of the knot boxes comprising:

a first former arranged to move towards the line wire-stay wire intersection from one side in forming a knot at the line wire-stay wire intersection at each operation of the knot box; and a second former arranged to move towards the line wire-stay wire intersection from a side opposite the first former at each operation of the knot box;

the machine comprising a hydraulic drive system arranged to move a plurality of the first formers and/or the second formers at each operation of the knot boxes.

2. The knotted fence mesh forming machine as claimed in claim 1, wherein the hydraulic drive system is arranged to simultaneously move the first formers of all of the knot boxes or the second formers of all of the knot boxes at each operation of the knot boxes.

3. The knotted fence mesh forming machine as claimed in claim 2, wherein the hydraulic drive system is arranged to move the first formers of all of the knot boxes simultaneously with one another and the second formers of all of the knot boxes simultaneously with one another at each operation of the knot boxes.

4. The knotted fence mesh forming machine as claimed in claim 2, wherein one or more hydraulic cylinders are operably connected to a drive bar, which is operably connected to the plurality of the first formers.

5. The knotted fence mesh forming machine as claimed in claim 4, wherein a hydraulic cylinder is operably connected to a transversely moveable rack bar having a plurality of camming surfaces defined therein, and a plurality of cam followers extend from the drive bar, each cam follower engaging with a respective one of the camming surfaces, the camming surfaces being arranged such that transverse movement of the rack bar results in orthogonal movement of the drive bar, thereby moving the first formers.

6. The knotted fence mesh forming machine as claimed in claim 2, wherein one or more hydraulic cylinders are operably connected to a drive bar, which is operably connected to the plurality of the second formers.

7. The knotted fence mesh forming machine as claimed in claim 6, wherein a hydraulic cylinder is operably connected to a transversely moveable rack bar having a plurality of camming surfaces defined therein, and a plurality of cam followers extend from the drive bar, each cam follower engaging with a respective one of the camming surfaces, the camming surfaces being arranged such that transverse movement of the rack bar results in orthogonal movement of the drive bar, thereby moving the second formers.

8. The knotted fence mesh forming machine as claimed in claim 1, comprising a plurality of hydraulic cylinders, with a ram of each hydraulic cylinder being operably connected to a respective first former.

9. The knotted fence mesh forming machine as claimed in claim 1, comprising a plurality of hydraulic cylinders, with a ram of each hydraulic cylinder being operably connected to a respective second former.

10. The knotted fence mesh forming machine as claimed in claim 1, wherein each knot box includes a first support arranged to support the line wire-stay wire intersection from the side opposite the first former during movement of the first former.

11. The knotted fence mesh forming machine as claimed in claim 10, wherein one or more hydraulic cylinders are operably connected to a drive bar, which is operably connected to the plurality of first supports.

12. The knotted fence mesh forming machine as claimed in claim 11, wherein a hydraulic cylinder is operably connected to a transversely moveable rack bar having a plurality of camming surfaces defined therein, and a plurality of cam followers extend from the drive bar, each cam follower engaging with a respective one of the camming surfaces, the camming surfaces being arranged such that transverse movement of the rack bar results in orthogonal movement of the drive bar, thereby moving the first supports.

13. The knotted fence mesh forming machine as claimed in claim 10, comprising a plurality of hydraulic cylinders, with a ram of each hydraulic cylinder being operably connected to a respective first support.

14. The knotted fence mesh forming machine as claimed in claim 13, wherein each hydraulic cylinder has two rams, with one ram operably connected to a respective first support and the other ram operably connected to a respective second former.

15. The knotted fence mesh forming machine as claimed in claim 1, wherein each knot box comprises a second support arranged to support the line wire stay wire intersection from the side opposite the second former during movement of the second former.

16. The knotted fence mesh forming machine as claimed in claim 15, wherein one or more hydraulic cylinders are operably connected to a drive bar, which is operably connected to the plurality of second supports.

17. The knotted fence mesh forming machine as claimed in claim 16, wherein a hydraulic cylinder is operably connected to a transversely moveable rack bar having a plurality of camming surfaces defined therein, and a plurality of cam followers extend from the drive bar, each cam follower engaging with a respective one of the camming surfaces, the camming surfaces being arranged such that transverse movement of the rack bar results in orthogonal movement of the drive bar, thereby moving the second supports.

18. The knotted fence mesh forming machine as claimed in claim 15, comprising a plurality of hydraulic cylinders, with a ram of each hydraulic cylinder being operably connected to a respective second support.

19. The knotted fence mesh forming machine as claimed in claim 18, wherein each hydraulic cylinder has two rams, one ram being operably connected to a respective second support, the other ram being operably connected to a respective first former.

20. A knotted fence mesh forming machine comprising a machine bed with a plurality of side by side knot boxes each for forming a knot at the intersection between a line wire and a stay wire, each of the knot boxes comprising:

a former arranged to move towards the line wire-stay wire intersection from one side and form a knot at the intersection at each operation of the knot box;

the machine including a drive system arranged to move a plurality of the formers at each operation of the knot boxes;

wherein at least some of the formers are hydraulically driven or hydraulically damped.

21. The knotted fence mesh forming machine as claimed in claim 20 comprising a hydraulic drive system arranged to simultaneously move a plurality of the formers at each operation of the knot boxes.

22. The knotted fence mesh forming machine as claimed in claim 21, wherein the hydraulic drive system comprises one or more hydraulic cylinders operably connected to a drive bar, which is operably connected to the plurality of the formers.

23. The knotted fence mesh forming machine as claimed in claim 22, wherein a hydraulic cylinder is operably connected to a transversely moveable rack bar having a plurality of camming surfaces defined therein, and a plurality of cam followers extend from the drive bar, each cam follower engaging with a respective one of the camming surfaces, the camming surfaces being arranged such that transverse movement of the rack bar results in orthogonal movement of the drive bar, thereby moving the formers.

24. The knotted fence mesh forming machine as claimed in claim 21, wherein the drive system comprises a plurality of hydraulic cylinders, with a ram of each hydraulic cylinder being operably connected to a respective former.

25. The knotted fence mesh forming machine as claimed in claim 20, wherein each former is hydraulically damped.

26. The knotted fence mesh forming machine as claimed in claim 25, wherein a damping hydraulic cylinder is operably connected to each former.

27. The knotted fence mesh forming machine as claimed in claim 26, wherein each damping hydraulic cylinder is located in a respective former holder.

28. The knotted fence mesh forming machine as claimed in claim 26, wherein each damping hydraulic cylinder is pressurized to a constant pressure.

29. The knotted fence mesh forming machine as claimed in claim 26, wherein the drive system is arranged to overstroke when moving a plurality of the formers at each operation of the knot boxes, and the damping hydraulic cylinders are arranged to compress slightly, thereby providing even pressure to each former at each operation of the knot boxes.

30. The knotted fence mesh forming machine as claimed in claim 25, wherein each former is a final former.

31. The knotted fence mesh forming machine as claimed in claim 20, wherein each former is a final former, and each knot box further comprises a first former arranged to move towards the line wire-stay wire intersection from a side opposite the final former at each operation of the knot box, prior to or concurrently with the movement of the final former.

32. The knotted fence mesh forming machine as claimed in claim 31 comprising a hydraulic drive system arranged to simultaneously move a plurality of the first formers at each operation of the knot boxes.

33. The knotted fence mesh forming machine as claimed in claim 32, wherein the hydraulic drive system comprises one or more hydraulic cylinders operably connected to a drive bar, which is operably connected to the plurality of the first formers.

34. The knotted fence mesh forming machine as claimed in claim 33, wherein a hydraulic cylinder is operably connected to a transversely moveable rack bar having a plurality of camming surfaces defined therein, and a plurality of cam followers extend from the drive bar, each cam follower engaging with a respective one of the camming surfaces, the camming surfaces being arranged such that transverse movement of the rack bar results in orthogonal movement of the drive bar, thereby moving the first formers.

35. The knotted fence mesh forming machine as claimed in claim 31, wherein the drive system comprises a plurality of hydraulic cylinders, with a ram of each hydraulic cylinder being operably connected to a respective first former.

36. A knotted fence mesh forming machine comprising a machine bed with a plurality of side by side knot boxes each for forming a knot at the intersection between a line wire and a stay wire, each of the knot boxes comprising:

a former arranged to move towards the line wire-stay wire intersection from one side and form a knot at the intersection at each operation of the knot box;

the machine including a drive system arranged to move a plurality of the formers at each operation of the knot boxes;

wherein at least some of the formers are hydraulically driven and hydraulically damped.

37. The knotted fence mesh forming machine as claimed in claim 36 comprising a hydraulic drive system arranged to simultaneously move a plurality of the formers at each operation of the knot boxes.

38. The knotted fence mesh forming machine as claimed in claim 37, wherein the hydraulic drive system comprises one or more hydraulic cylinders operably connected to a drive bar, which is operably connected to the plurality of the formers.

39. The knotted fence mesh forming machine as claimed in claim 38, wherein a hydraulic cylinder is operably connected to a transversely moveable rack bar having a plurality of camming surfaces defined therein, and a plurality of cam followers extend from the drive bar, each cam follower engaging with a respective one of the camming surfaces, the camming surfaces being arranged such that transverse movement of the rack bar results in orthogonal movement of the drive bar, thereby moving the formers.

40. The knotted fence mesh forming machine as claimed in claim 36, wherein the drive system comprises a plurality of hydraulic cylinders, with a ram of each hydraulic cylinder being operably connected to a respective former.

41. The knotted fence mesh forming machine as claimed in claim 36, wherein each former is hydraulically damped.

42. The knotted fence mesh forming machine as claimed in claim 41, wherein a damping hydraulic cylinder is operably connected to each former.

43. The knotted fence mesh forming machine as claimed in claim 42, wherein each damping hydraulic cylinder is located in a respective former holder.

44. The knotted fence mesh forming machine as claimed in claim 42, wherein each damping hydraulic cylinder is pressurized to a constant pressure.

45. The knotted fence mesh forming machine as claimed in claim 42, wherein the drive system is arranged to overstroke when moving a plurality of the formers at each operation of the knot boxes, and the damping hydraulic cylinders are arranged to compress slightly, thereby providing even pressure to each former at each operation of the knot boxes.

46. The knotted fence mesh forming machine as claimed in claim 41, wherein each former is a final former.

47. The knotted fence mesh forming machine as claimed in claim 36 wherein each former is a final former, and each knot box further comprises a first former arranged to move towards the line wire-stay wire intersection from a side opposite the final former at each operation of the knot box, prior to or concurrently with the movement of the final former.

48. The knotted fence mesh forming machine as claimed in claim 47 comprising a hydraulic drive system arranged to simultaneously move a plurality of the first formers at each operation of the knot boxes.

49. The knotted fence mesh forming machine as claimed in claim 48, wherein the hydraulic drive system comprises one or more hydraulic cylinders operably connected to a drive bar, which is operably connected to the plurality of the first formers.

50. The knotted fence mesh forming machine as claimed in claim 49, wherein a hydraulic cylinder is operably connected to a transversely moveable rack bar having a plurality of camming surfaces defined therein, and a plurality of cam followers extend from the drive bar, each cam follower engaging with a respective one of the camming surfaces, the camming surfaces being arranged such that transverse movement of the rack bar results in orthogonal movement of the drive bar, thereby moving the first formers.

51. The knotted fence mesh forming machine as claimed in claim 47, wherein the drive system comprises a plurality of hydraulic cylinders, with a ram of each hydraulic cylinder being operably connected to a respective first former.

* * * * *

UNITED STATES PATENT AND TRADEMARK OFFICE

CERTIFICATE OF CORRECTION

PATENT NO. : 6,715,512 B2
DATED : April 6, 2004
INVENTOR(S) : Kenneth Sidney Richardson It is certified that error appears in the above-identified patent and that said Letters Patent is hereby corrected as shown below:

Column 2,
Lines 12, 15, 18 and 24, change “first former” to -- first formers --
Lines 13, 16, 20, 38 and 47, change “second former” to -- second formers --

Column 3,
Lines 38, 40, 43, 47, 55 and 66, change “former” to -- formers --

Column 4,
Lines 10, 15 and 23, change “first former” to -- first formers --

Column 7,
Lines 45 and 48, change “staple former” to -- staple formers --
Lines 51, 62 and 66, change “final former” to -- final formers --

Column 8,
Line 3, change “staple former” to -- staple formers --

Column 10,
Lines 21, 43, 51 and 52, change “staple former” to -- staple formers --
Line 62, change “final former” to -- final formers --

Column 11,
Lines 4 and 5, change “former” to -- formers --
Line 8, change “staple former” to -- staple formers --
Line 8, change “final former” to -- final formers --

Column 12,
Line 35, delete “in” after “then engage”

UNITED STATES PATENT AND TRADEMARK OFFICE

CERTIFICATE OF CORRECTION

PATENT NO. : 6,715,512 B2
DATED : April 6, 2004
INVENTOR(S) : Kenneth Sidney Richardson It is certified that error appears in the above-identified patent and that said Letters Patent is hereby corrected as shown below:

Column 13,
Line 8, change “216'extends” to -- 216' extends --
Line 37, change “final former” to -- final formers --
Line 38, change “staple former” to -- staple formers --
Lines 41, 42 and 49, change “former” to -- formers --
Line 55 (two occurrences) change “two former” to -- two formers --

Signed and Sealed this

Tenth Day of August, 2004

JON W. DUDAS
*Acting Director of the United States Patent and Trademark Office*